US011555294B2

(12) United States Patent
Hita et al.

(10) Patent No.: US 11,555,294 B2
(45) Date of Patent: Jan. 17, 2023

(54) WORK MACHINE

(71) Applicant: HITACHI CONSTRUCTION MACHINERY CO., LTD., Tokyo (JP)

(72) Inventors: Masafumi Hita, Kashiwa (JP); Yasuhiko Kanari, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 327 days.

(21) Appl. No.: 16/639,798

(22) PCT Filed: Nov. 20, 2018

(86) PCT No.: PCT/JP2018/042890
§ 371 (c)(1),
(2) Date: Feb. 18, 2020

(87) PCT Pub. No.: WO2019/116842
PCT Pub. Date: Jun. 20, 2019

(65) Prior Publication Data

US 2020/0370278 A1 Nov. 26, 2020

(30) Foreign Application Priority Data

Dec. 14, 2017 (JP) ..... JP2017-239989

(51) Int. Cl.
*E02F 9/22* (2006.01)
*E02F 3/43* (2006.01)
*E02F 9/20* (2006.01)

(52) U.S. Cl.
CPC ..... *E02F 9/2246* (2013.01); *E02F 3/435* (2013.01); *E02F 3/437* (2013.01); *E02F 9/2041* (2013.01)

(58) Field of Classification Search
CPC ..... E02F 3/435; E02F 3/437; E02F 9/2041
See application file for complete search history.

(56) References Cited

U.S. PATENT DOCUMENTS 616,948 A 1/1899 Malmquist
5,835,874 A * 11/1998 Hirata ..... E02F 3/435 60/426

(Continued)

FOREIGN PATENT DOCUMENTS

CN 107306500 A 10/2017
JP 10-008493 A 1/1998

(Continued)

OTHER PUBLICATIONS

Machine Translation of JP 10-168929 via Espacenet (Year: 1998).*

(Continued)

*Primary Examiner* — Michael Leslie
*Assistant Examiner* — Matthew Wiblin
(74) *Attorney, Agent, or Firm* — Mattingly & Malur, PC

(57) ABSTRACT

When a machine-control ON/OFF switch is switched to the ON position, a controller outputs either a first control signal generated by an operation lever or a second control signal that operates a boom cylinder in accordance with a predetermined condition; when the ON/OFF switch is switched to the OFF position, the controller outputs the first control signal; when a control signal has been switched from one of the first control signal and the second control signal to the other control signal by the operation of the ON/OFF switch, the controller applies a rate limit to the control signal, and controls the boom cylinder on the basis of the control signal obtained after the limitation.

5 Claims, 16 Drawing Sheets

(56) References Cited

U.S. PATENT DOCUMENTS

| | | | | |
|---|---|---|---|---|
| 6,098,322 | A | 8/2000 | Tozawa et al. | |
| 6,169,948 | B1 | 1/2001 | Fujishima et al. | |
| 2017/0247861 | A1 | 8/2017 | Matsuyama et al. | |
| 2017/0292247 | A1* | 10/2017 | Yokoo | E02F 9/2004 |
| 2019/0338494 | A1 | 11/2019 | Moriki et al. | |

FOREIGN PATENT DOCUMENTS

| | | | |
|---|---|---|---|
| JP | 10-168929 | A | 6/1998 |
| JP | 2001-098585 | A | 4/2001 |
| JP | 2002-167794 | A | 6/2002 |
| JP | 6072993 | B1 | 2/2017 |
| WO | 2017/168822 | A1 | 10/2017 |

OTHER PUBLICATIONS

Machine Translation of JP 2001-98585 via J-PlatPat (Year: 2001).*
Chinese Office Action received in corresponding Chinese Application No. 201880052449.9 dated Jun. 4, 2021.
International Preliminary Report on Patentability received in corresponding International Application Mo PCT/JP2018/042890 dated Jun. 25, 2020.
International Search Report of PCT/JP2018/042890 dated Jan. 15, 2019.

* cited by examiner

WORK MACHINE

TECHNICAL FIELD

The present invention relates to a work machine that operates a work implement in accordance with a predetermined condition.

BACKGROUND ART

Techniques for improving the work efficiency of a work machine (e.g. a hydraulic excavator) including a work implement (e.g. a front work implement) driven by hydraulic actuators include machine control (Machine Control: MC). MC is a technique for assisting operation by an operator by executing semi-automatic control for operating a work implement in accordance with a predetermined condition in a case where an operation device (operation lever) is operated by the operator.

In recent years, for the purpose of improving construction precision and efficiency, active efforts are being made for development of computerized construction machines in which respective machine bodies retain data about target construction surfaces, and a semi-automatically control operation of work implements is performed such that the work implements do not move into the target construction surfaces. An operator proceeds the construction works by using a computerized construction machine while switching the semi-automatic control between ON and OFF.

For example, Patent Document 1 discloses a work-vehicle control system that includes: a first operation lever for a work machine; a first operation member provided to the first operation lever; and a controller that performs automatic control of the work machine. In the work-vehicle control system, the controller executes an automatic control function allocated to the first operation member in accordance with operation of the first operation member when an execution condition including that the first operation lever is at a neutral position is satisfied. Further, Patent Document 1 states that, according to the work-vehicle control system, "The automatic control function allocated to the first operation member is executed in accordance with operation of the first operation member when the execution condition including that the first operation lever is at the neutral position is satisfied. Because of this, it is possible to prevent simultaneously performing an execution of the automatic control function allocated to the first operation member and an operation of the work machine through the first operation lever even if the first operation lever is moved during operation of the first operation member. Thereby, it is possible to prevent unintended operation of the work machine due to an operational error, and construction with high quality by automatic control can be performed."

PRIOR ART DOCUMENT

Patent Document

Patent Document 1: Japanese Patent No. 6072993

SUMMARY OF THE INVENTION

Problem to be Solved by the Invention

Typically, operators familiar with a steering operation of work machines often operate at least one of operation levers at any time. Accordingly, the technique described in Patent Document 1 that requires an operation lever to be positioned at its neutral position every time automatic control is switched between ON and OFF possibly causes interruptions of natural steering operation by the operators, and this causes operation stresses.

An object of the present invention is to provide a work machine that does not cause operation stresses to operators upon MC ON/OFF switching.

Means for Solving the Problem

The present application includes a plurality of means for solving the problem explained above, and as one example of the means, there is provided a work machine including: a work implement; a first hydraulic actuator that drives the work implement; an operation device that outputs a first control signal for the first hydraulic actuator in accordance with operation by an operator; a controller that, while the operation device is being operated, calculates a second control signal for operating the first hydraulic actuator in accordance with a predetermined condition, and controls the first hydraulic actuator on a basis of either the first control signal or the second control signal; and a switching device that can select a switch position of either an ON position enabling control of the first hydraulic actuator or an OFF position disabling control of the first hydraulic actuator, the control being based on the second control signal. In the work machine, the controller: controls the first hydraulic actuator on a basis of either the first control signal or the second control signal when the switching device is switched to the ON position; controls the first hydraulic actuator on a basis of the first control signal when the switching device is switched to the OFF position; and limits, to a predetermined change rate, a control-signal temporal change rate at which one of the first control signal and the second control signal is changed to other of the one control signal, and controls the first hydraulic actuator on a basis of a control signal obtained after the limitation, when a control signal for controlling the first hydraulic actuator has been switched from the one control signal to the other control signal by a switching operation on the switching device.

Advantages of the Invention

The present invention makes possible MC ON/OFF switching without causing operation stresses to operators.

MODES FOR CARRYING OUT THE INVENTION

Hereinafter, an embodiment of the present invention is explained by using the drawings.

<1. Hardware Configuration of Hydraulic Excavator>

Figure 1:
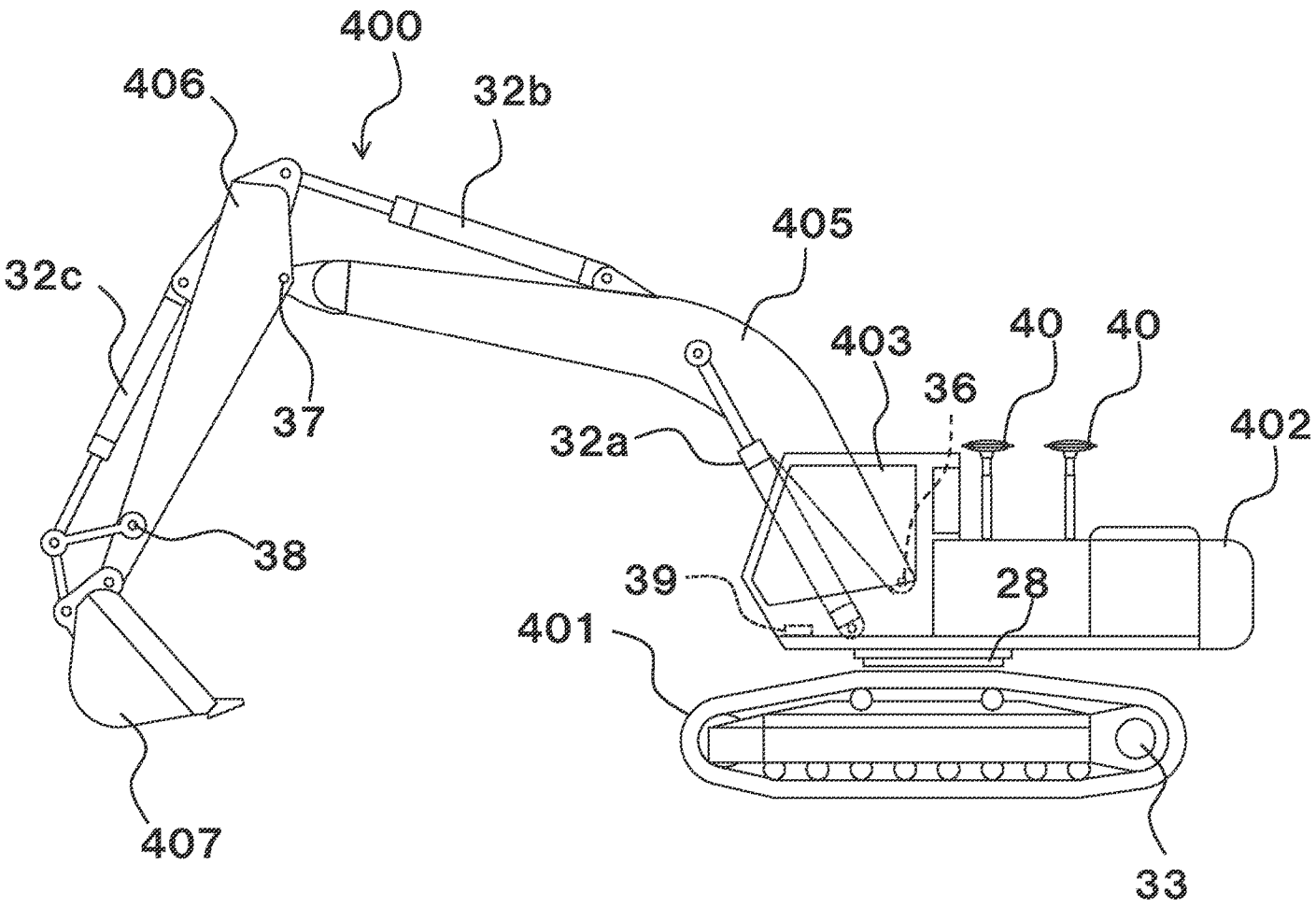
FIG. 1 is a schematic configuration diagram of a hydraulic excavator according to an embodiment of the present invention.

FIG. 1 is a schematic configuration diagram of a hydraulic excavator according to an embodiment of the present invention. In FIG. 1, the hydraulic excavator includes a crawler-type track structure 401, and a swing structure 402 attached swingably to an upper portion of the track structure 401. The track structure 401 is driven by a traveling hydraulic motor 33. The swing structure 402 is driven by a torque generated by a swing hydraulic motor 28, and swings to the left and right.

An operation room 403 is installed on the swing structure 402, and an articulated-type front work implement 400 capable of performing works for forming a target construction surface is attached to a front portion of the swing structure 402.

The front work implement 400 includes a boom 405 driven by a boom cylinder (first hydraulic actuator) 32*a*, an arm 406 driven by an arm cylinder (second hydraulic actuator) 32*b*, and a bucket 407 driven by a bucket cylinder 32*c*.

In the operation room 403, there are installed: an operation lever 26 for generating control signals (pilot pressures (hereinafter, also referred to as "Pi-pressures") output from a gear pump 24 (see FIG. 2)) for the boom cylinder 32*a*, the arm cylinder 32*b*, the bucket cylinder 32*c*, the traveling hydraulic motor 33 and the swing hydraulic motor 28 in accordance with an operation direction and an operation amount, in order to operate the boom 405, the arm 406, the bucket 407, the swing structure 402 and the track structure 401 by the control signals; and an engine control dial 51 (see FIG. 2) issuing a command for a target speed of an engine 21 (see FIG. 2). In this document, a pilot pressure for the boom cylinder 32*a* generated by the operation lever 26 is referred to as a first control signal, and a pilot pressure for the arm cylinder 32*b* generated by the operation lever 26 is referred to as a third control signal in some cases.

Figure 2:
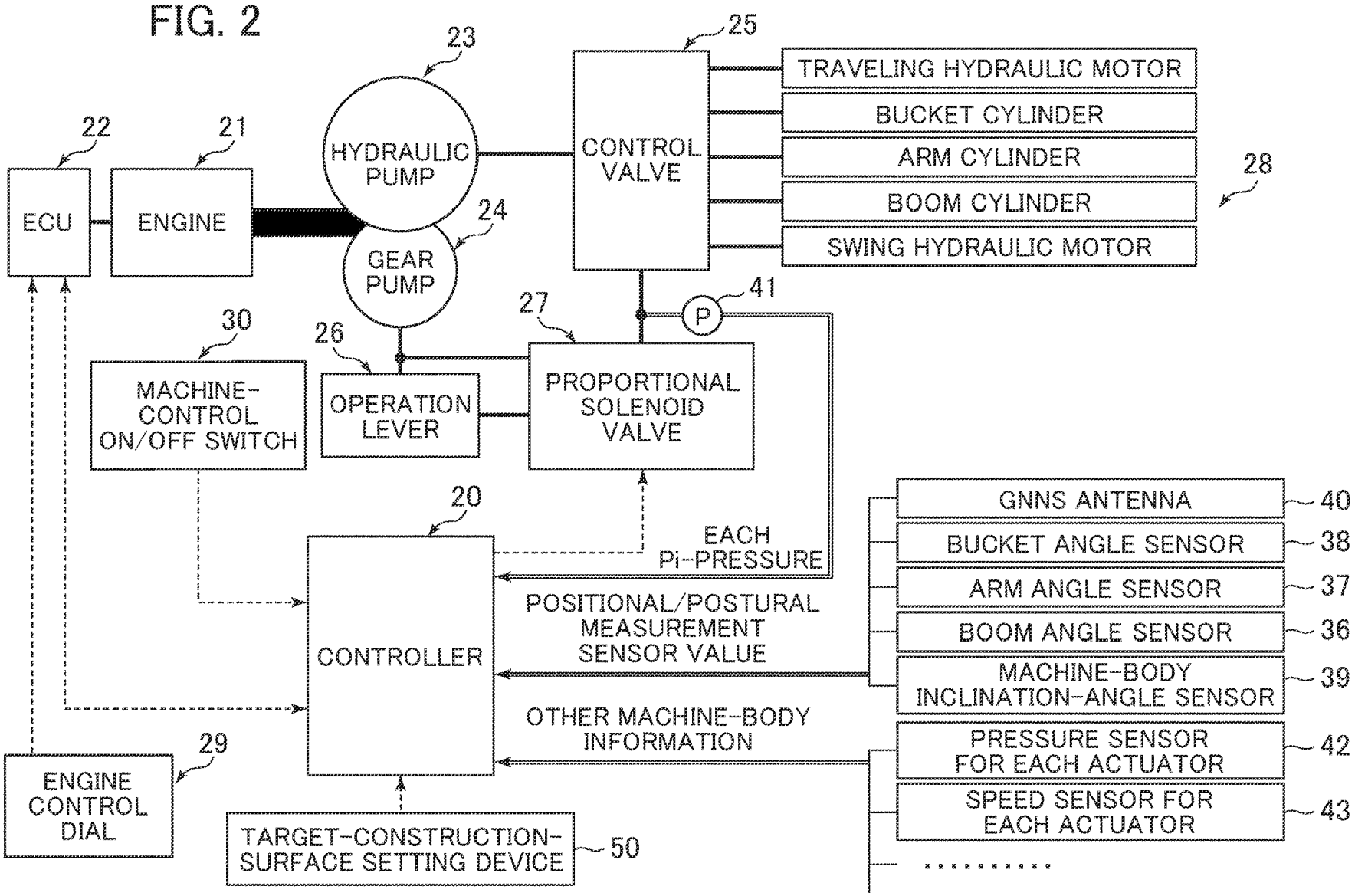
FIG. 2 is a system configuration diagram of the hydraulic excavator in FIG. 1.

FIG. 2 is a system configuration diagram of the hydraulic excavator in FIG. 1. The hydraulic excavator in the present embodiment includes: an engine 21; an engine control unit (ECU) 22 which is a controller for controlling the engine 21; a hydraulic pump 23 and the gear pump (pilot pump) 24 that are mechanically coupled to the output shaft of the engine 21 and are driven by the engine 21; the operation lever 26 that outputs, to a control valve 25 via a proportional solenoid valve 27, a control signal for each of the hydraulic actuators 28, 33, 32*a*, 32*b* and 32*c* which control signal is obtained by reducing the pressure of a hydraulic fluid delivered from the gear pump 24 in accordance with an operation amount; a plurality of control valves 25 each of which controls the flow rate and direction of a hydraulic operating fluid introduced from the hydraulic pump 23 into each of the hydraulic actuators 28, 33, 32*a*, 32*b* and 32*c* on the basis of a control signal (a pilot pressure (hereinafter, referred to as a Pi-pressure in some cases)) output from the operation lever 26 or the proportional solenoid valve 27; a plurality of pressure sensors 41 each of which senses the pressure value of a Pi-pressure acting on each of the control valves 25; a controller (controller) 20 which is a computer that computes a corrected Pi-pressure on the basis of the position and posture of the front work implement 400 and other machine-body information, and outputs a command voltage that can generate the corrected Pi-pressure to the proportional solenoid valve 27; and a target-construction-surface setting device 50 for inputting data on a target construction surface with a target shape of a work target of the front work implement 400 to the controller 20.

The hydraulic pump 23 is mechanically controlled in terms of its torque and flow rate such that the machine body operates in accordance with a target output-power (mentioned below) for each of the hydraulic actuators 28, 33, 32*a* 32*b* and 32*c*.

Although the number of control valves 25 is the same as the number of the control-target hydraulic actuators 28, 33, 32*a*, 32*b* and 32*c*, they are collectively illustrated as one control valve in FIG. 2. Two Pi-pressures are acting on each control valve to move a spool inside the control valve in one or the other axial direction. For example, a boom-raising Pi-pressure and a boom-lowering Pi-pressure act on a control valve 25 for the boom cylinder 32*a*.

The pressure sensors 41 each sense a Pi-pressure acting on one control valve 25, and are present twice the number of the control valves. The pressure sensors 41 are provided immediately under the control valves 25, and actually sense Pi-pressures acting on the control valves 25.

Although a plurality of proportional solenoid valves 27 are present, they are collectively illustrated as one block in FIG. 2. There are two types of proportional solenoid valves 27. One of the types is pressure-reducing valves that directly output a Pi-pressure input from the operation lever 26 or reduce the Pi-pressure to a desired corrected Pi-pressure designated by a command voltage and then output the reduced Pi-pressure, and the other of the types is pressure-increasing valves that reduce a Pi-pressure input from the gear pump 24 to a desired corrected Pi-pressure designated by a command voltage and then output the reduced Pi-pressure in a case where a Pi-pressure higher than a Pi-pressure output by the operation lever 26 is required. In a case where a Pi-pressure higher than a Pi-pressure being output from the operation lever 26 is required for a Pi-pressure applied to one of the control valves 25, a Pi-pressure is produced via a pressure-increasing valve; in a case where a Pi-pressure lower than a Pi-pressure being output from the operation lever 26 is required, a Pi-pressure is produced via a pressure-reducing valve; and in a case where a Pi-pressure is not being output from the operation lever 26, a Pi-pressure is produced via a pressure-increasing valve. That is, pressure-reducing valves and pressure-increasing valves can cause a Pi-pressure with a pressure value different from a Pi-pressure input from the operation lever 26 (a Pi-pressure based on operator operation) to act on a control valve 25, and can cause a control-target hydraulic actuator of the control valve 25 to perform desired operation.

The two pressure-reducing valves and the two pressure-increasing valves may be provided at a maximum for one control valve 25. In the present embodiment, two pressure-reducing valves and two pressure-increasing valves are provided for the control valve 25 of the boom cylinder 32*a*, and one pressure-reducing valve is provided for the control valve 25 of the arm cylinder 32*b*. Specifically, the hydraulic excavator includes: a first pressure-reducing valve provided in a first line that guides a boom-raising Pi-pressure from the operation lever 26 to the control valve 25; a first pressure-increasing valve provided in a second line that guides a boom-raising Pi-pressure from the gear pump 24 to the control valve 25, bypassing the operation lever 26; a second pressure-reducing valve provided in a third line that guides a boom-lowering Pi-pressure from the operation lever 26 to the control valve 25; a second pressure-increasing valve provided in a fourth line that guides a boom-lowering Pi-pressure from the gear pump 24 to the control valve 25, bypassing the operation lever 26; and a third pressure-reducing valve provided in a fifth line that guides an arm-crowding Pi-pressure from the operation lever 26 to the control valve 25.

The proportional solenoid valves 27 in the present embodiment are provided only for the control valves 25 of the boom cylinder 32*a* and the arm cylinder 32*b*, and there are no proportional solenoid valves 27 for control valves 25 of the other actuators 28, 33 and 32*c*. Accordingly, the bucket cylinder 32*c*, the swing hydraulic motor 28 and the traveling hydraulic motor 33 are driven on the basis of Pi-pressures output from the operation lever 26.

Note that all Pi-pressures (control signals for the boom and the arm) input to the control valves 25 for the boom cylinder 32*a* and the arm cylinder 32*b* are referred to as "corrected Pi-pressures" (or corrected control signals) in this document no matter whether the Pi-pressures are corrected by the proportional solenoid valve 27.

In addition, in this document, controlling the boom cylinder 32*a* and the arm cylinder 32*b* on the basis of Pi-pressures corrected by the proportional solenoid valve 27 in order to operate the front work implement 400 in accordance with a predetermined condition during operation of the operation lever 26 is referred to as machine control (Machine Control: MC) in some cases. For example, in the present embodiment, MC keeping the bucket 407 on a target construction surface 60 set in any manner (see FIG. 5) or an area above the target construction surface 60 is possible. In addition, in this document, MC is referred to as "semi-automatic control" controlling, by the controller 20, an operation of the front work implement 400 only at the time when the operation lever 26 is being operated, in contrast to "automatic control" controlling, by the controller 20, an operation of the front work implement 400 at the time when the operation lever 26 is not being operated.

Figure 16:
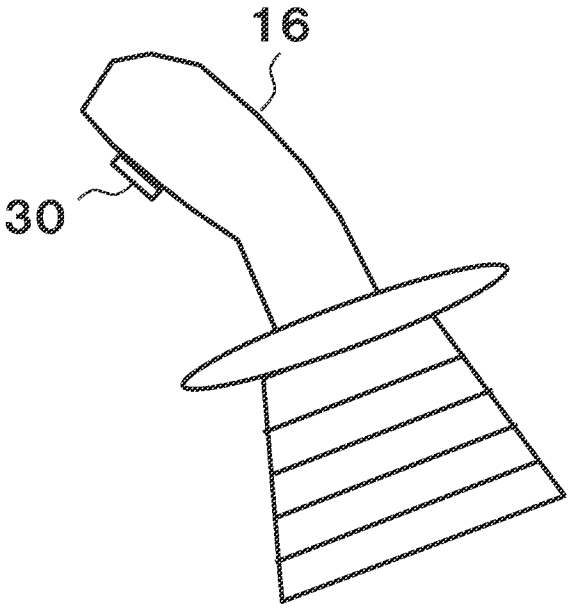
FIG. 16 is a side view of an operation lever 26.

The operation lever 26 has a joystick shape, and the rear side of its grip section is provided with a machine-control ON/OFF switch (hereinafter, simply referred to as a "switch" in some cases) 30 as illustrated in FIG. 16. The switch 30 can be constituted by a seesaw switch, for example, and can select a switch position of either an ON position enabling MC based on a corrected Pi-pressure for the proportional solenoid valve 27 or an OFF position disabling MC based on a corrected Pi-pressure for the proportional solenoid valve 27. The switch 30 is pressed by an index finger of an operator gripping the operation lever 26, for example, and the switch position of the switch can be changed during operation of the operation lever 26. The switch 30 does not need to be a seesaw switch, and can be another switch as long as the switch 30 can be switched between the two positions explained above. The switch 30 is connected to the controller 20, and the switch position of the switch 30 is output to the controller 20.

The controller 20 has: an input section; a central processing unit (CPU) which is a processor; a read-only memory (ROM) and a random access memory (RAM) which are storage devices; and an output section. The input section converts various types of data input to the controller 20, such that the CPU can perform calculation on those various types of data. The ROM is a recoding medium on which a control program for executing calculation processes mentioned below, various types of data required for execution of the calculation processes and the like are stored, and the CPU performs predetermined calculation processes on signals taken in from the input section, the ROM and the RAM in accordance with the control program stored on the ROM. A Command for driving the engine 21 at a target speed, a command required for causing a command voltage to act on the proportional solenoid valve 27, and the like are output from the output section. Note that the storage devices are not limited to semiconductor memories like the ROM and the RAM that are explained above, but magnetic storage devices such as a hard disk drive can be alternatively used, for example.

The ECU 22; the plurality of pressure sensors 41; two GNSS antennas 40; a bucket angle sensor 38; an arm angle sensor 37; a boom angle sensor 36; a machine-body inclination-angle sensor 39; a plurality of pressure sensors 42 each for sensing the pressure of the hydraulic actuator 28, 33, 32*a* 32*b* or 32*c*; a plurality of speed sensors 43 each for sensing the operation speed of the hydraulic actuator 28, 33, 32*a* 32*b* or 32*c*; and the target-construction-surface setting device 50 are connected to the controller 20.

The controller 20 computes the machine-body position relative to the target construction surface 60 on the basis of input signals from the GNSS antennas 40, and computes the posture of the front work implement 400 on the basis of input signals from the bucket angle sensor 38, the arm angle sensor 37, the boom angle sensor 36 and the machine-body inclination-angle sensor 39. That is, in the present embodiment, the GNSS antennas 40 function as position sensors, and the bucket angle sensor 38, the arm angle sensor 37, the boom angle sensor 36 and the machine-body inclination-angle sensor 39 function as posture sensors. Note that the angle of inclination of the machine body may be computed from input signals from the two GNSS antennas 40.

In the present embodiment, stroke sensors are used as the speed sensors 43 of the hydraulic cylinders 32*a*, 32*b* and 32*c*. In addition, each of the hydraulic cylinders 32*a*, 32*b* and 32*c* includes a bottom pressure sensor and a rod pressure sensor as the pressure sensors 42 of the hydraulic cylinders 32*a*, 32*b* and 32*c*.

Note that means and methods used in computation of the machine-body position, the posture of the front work implement 400, the pressure of each actuator, and the speed of each actuator explained in this document are merely examples, and known computation means and methods can be used.

The target-construction-surface setting device 50 is an interface into which data (including the positional data and the inclination-angle data of each target construction surface) about the target construction surface 60 (see FIG. 5) can be input. The target-construction-surface setting device 50 is connected with an external terminal (not illustrated) storing three-dimensional data of a target construction surface defined on a global coordinate system (absolute coordinate system), and data on the target construction surface input from the external terminal is stored in a storage device in the controller 20 via the target-construction-surface setting device 50. Note that the target construction surface may be input manually by an operator through the target-construction-surface setting device 50.

<2. Calculation Configuration of Controller 20>

Figure 3:
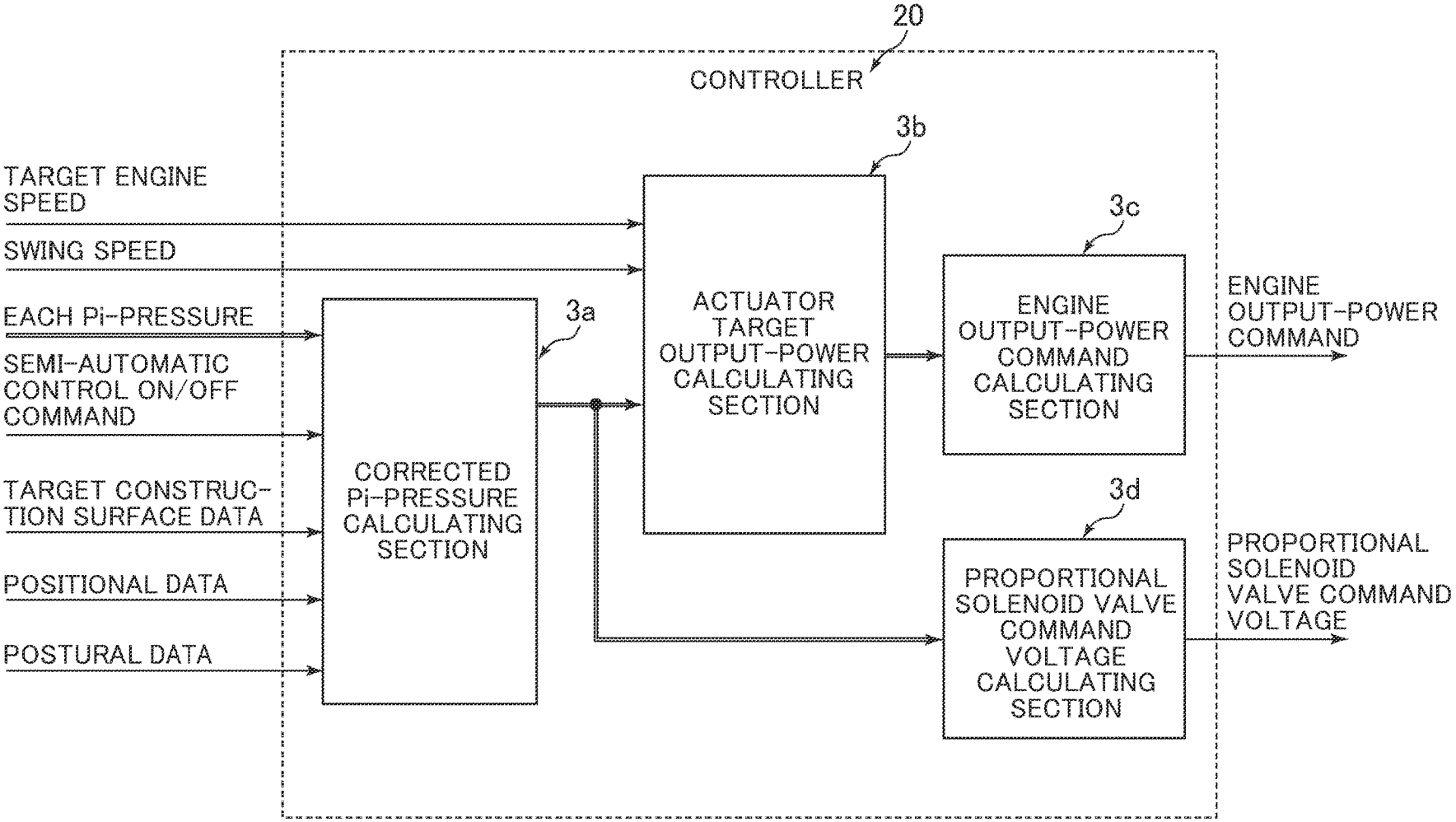
FIG. 3 is a calculation configuration diagram of a controller 20.

FIG. 3 is a calculation configuration diagram of the controller 20. The controller 20 includes: an actuator target output-power calculating section 3*b* that calculates target output-powers of the hydraulic cylinders 32*a*, 32*b* and 32*c*, and the swing hydraulic motor 28; a corrected Pi-pressure calculating section 3*a* that computes corrected Pi-pressures of the boom cylinder 32*a* (boom 405) and the arm cylinder 32*b* (arm 406); a proportional solenoid valve command voltage calculating section 3*d* that computes command voltages (proportional solenoid valve command voltages) for the four proportional solenoid valves 27 (the first and second pressure-reducing valves, and the first and second pressure-increasing valves) for the boom cylinder 32*a*, and the one proportional solenoid valve 27 (third pressure-reducing valve) for the arm cylinder 32*b* on the basis of the corrected Pi-pressures; and an engine output-power command calculating section 3*c* that computes an engine output-power command to be output to the ECU 22.

<2.1. Corrected Pi-Pressure Calculating Section 3*a*>

Figure 4:
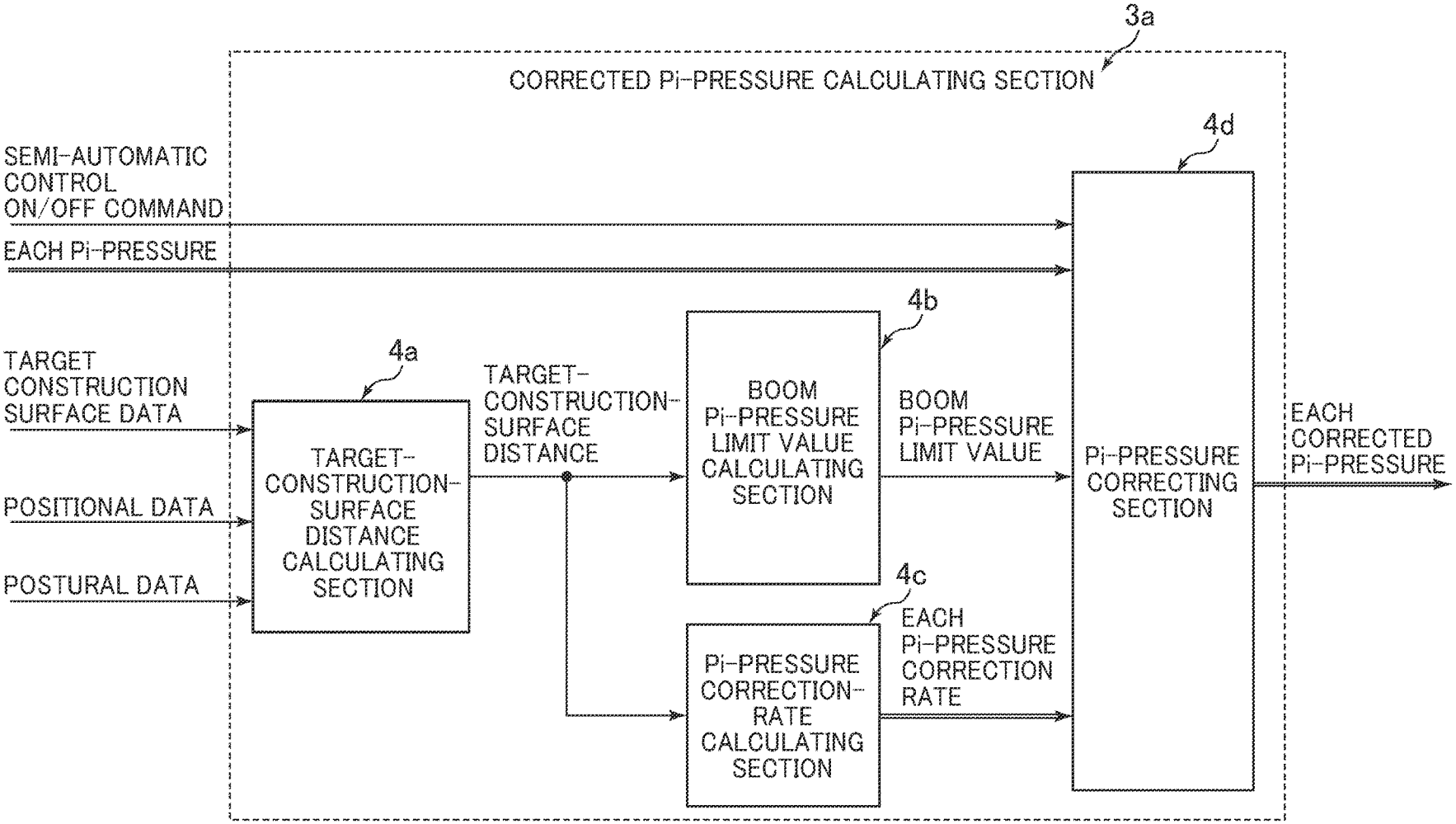
FIG. 4 is a detail view of a corrected Pi-pressure calculating section.

FIG. 4 is a detail view of the corrected Pi-pressure calculating section 3*a*. The corrected Pi-pressure calculating section 3*a* includes a target-construction-surface distance calculating section 4*a*, a boom Pi-pressure limit value calculating section 4*b*, a Pi-pressure correction-rate calculating section 4*c* and a Pi-pressure correcting section 4*d*. Hereinafter, Pi-pressures as commands for boom-raising, arm-crowding, bucket-crowding and a right swing are defined as "positive pressures," and Pi-pressures as commands for boom-lowering, arm-dumping, bucket-dumping and a left swing are defined as "negative pressures."

<2.1.1. Target-Construction-Surface Distance Calculating Section 4*a*>

The target-construction-surface distance calculating section 4*a* receives inputs of: data on the target construction surface 60 input via the target-construction-surface setting device 50; positional data on the machine body computed on the basis of an input from the GNSS antennas 40; and postural data and positional data on the front work implement 400 computed on the basis of inputs from the angle sensors 36, 37, 38 and 39. From these types of input data, the target-construction-surface distance calculating section 4*a* creates a cross-sectional view of a target construction surface obtained by cutting the target construction surface 60 along a plane which is parallel to the swing axis and passes through the center of gravity of the bucket 407, and computes the distance D, in the cross-section, between the claw-tip position of the bucket 407 and the target construction surface 60. The distance D is defined as the distance between the claw tip (tip) of the bucket 407 and the intersection of the cross-section and the perpendicular line drawn from the claw tip of the bucket 407 to the target construction surface 60.

<2.1.2. Boom Pi-Pressure Limit Value Calculating Section 4*b*>

The boom Pi-pressure limit value calculating section (second control signal calculating section) 4*b* computes a Pi-pressure limit value (referred to as a "second control signal" in some cases) of the boom at the time of MC, on the basis of the target-construction-surface distance D computed at the target-construction-surface distance calculating section 4*a*. It should be noted, however, that in a case where the operation lever 26 is at its neutral position, the boom Pi-pressure limit value calculating section 4*b* outputs zero as the boom Pi-pressure limit value no matter what the distance D is. In other cases, the boom Pi-pressure limit value calculating section 4*b* calculates the boom Pi-pressure limit value in the following manner.

First, the boom Pi-pressure limit value calculating section 4*b* computes a target value (target velocity vertical component) V1'*y* of a component of the velocity vector of the claw tip of the bucket 407 which is perpendicular to the target construction surface 60 (hereinafter, abbreviated to the "vertical component"), on the basis of the distance D and the table in FIG. 6. The target velocity vertical component V1'*y* is zero when the distance D is zero, and is set such that the target velocity vertical component V1'*y* decreases monotonically in accordance with an increase in the distance D and that the target velocity vertical component V1'*y* becomes $-\infty$ if the distance D becomes larger than a predetermined value d1. The manner of deciding the target velocity vertical component V1'*y* is not limited to the one illustrated by the table in FIG. 6, and any manner can be used alternatively as long as the target velocity vertical component V1'*y* decreases monotonically at least if the distance D is in the range of zero to a predetermined positive value.

Figure 5:
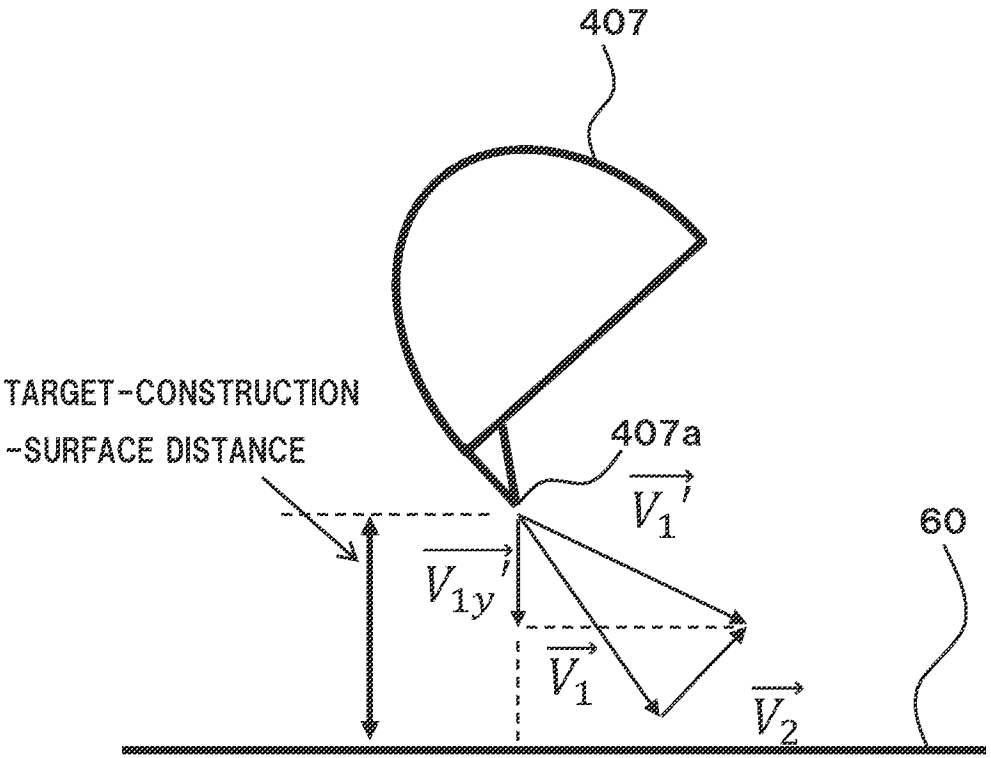
FIG. 5 is a figure for explaining a bucket claw-tip locus correction.

As illustrated in FIG. 5, in the present embodiment, by adding a velocity vector V2 that is generated by boom-raising to a velocity vector V1 of the claw tip of the bucket 407, the velocity vector of the claw tip of the bucket 407 is corrected to be V1' such that the vertical component of the velocity vector of the claw tip of the bucket 407 is kept at a target velocity vertical component V1'*y*. The boom Pi-pressure limit value calculating section 4*b* computes a boom Pi-pressure (boom Pi-pressure limit value) required for generating the velocity vector V2 by boom-raising. In addition, the correlation between the boom Pi-pressure limit value and V2 may be acquired previously by measuring boom-raising characteristics in advance. Note that, in the present embodiment, the boom Pi-pressure limit value is a value equal to or larger than zero, that is, a Pi-pressure with which boom-raising is performed.

For example, in the case of FIG. 5, the vector V1 is a bucket claw-tip velocity vector before correction computed from postural data of the front work implement 400 and each cylinder speed. Since the vertical component of the vector V1 points the same direction as the target velocity vertical component V1'*y*, and its magnitude is greater than the magnitude of the limit value V1'*y*, the vector V1 needs to be corrected such that the vertical component of the bucket claw-tip velocity vector after correction becomes V1'*y* by adding the velocity vector V2 generated by boom-raising. The direction of the vector V2 is the direction of the tangent line of a circle having a radius which coincides with the distance from the center of revolution of the boom 405 to a bucket claw-tip 407*a*, and can be computed from the posture of the front work implement 400 at the moment of the computation. Then, the vector that points the computed direction, and has such a magnitude that, if the vector is added to the vector V1 before correction, the vertical component of the vector V1' after correction becomes V1'*y* is determined as V2. Since the vector V2 is determined uniquely, the boom Pi-pressure limit value calculating section 4*b* can compute the boom Pi-pressure limit value required for generating the vector V2. Note that the magnitude of V2 may be obtained by applying the law of cosines by using the magnitudes of V1 and V1' and the angle θ formed by V1 and V1'.

Figure 6:
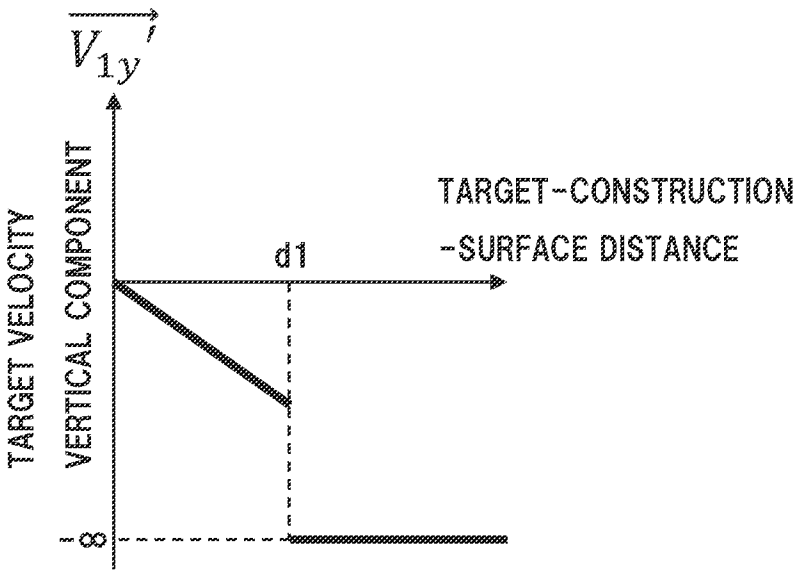
FIG. 6 is a calculation table for a target velocity vertical component V1$y'$.

Since if the target velocity vertical component V1'*y* of the claw-tip velocity vector is determined as illustrated by the table in FIG. 6, the vertical component of the claw-tip velocity vector gradually approaches zero as the bucket claw-tip 407*a* approaches the target construction surface 60, it is possible to prevent the claw tip 407*a* from moving down into the target construction surface 60.

<2.1.3. Pi-Pressure Correcting Section 4*d*>

The Pi-pressure correcting section 4*d* is a section that calculates Pi-pressures (corrected Pi-pressures) to be act on the control valves 25 of the hydraulic actuators 28, 33, 32*a* 32*b* and 32*c* on the basis of the switch position of the switch 30, a Pi-pressure output from the operation lever 26, a boom Pi-pressure limit value calculated at the boom Pi-pressure limit value calculating section 4*b*, and a Pi-pressure correction rate calculated at the Pi-pressure correction-rate calculating section 4*c*. A Pi-pressure correcting section 4*d* can be provided for each of the hydraulic actuators 28, 33, 32*a*, 32*b* and 32*c*. Here, details of a Pi-pressure correcting section 4*d* for boom-raising and boom-lowering and a Pi-pressure correcting section 4*d* for arm-crowding are explained by using FIG. 8 and FIG. 9.

Figure 8:
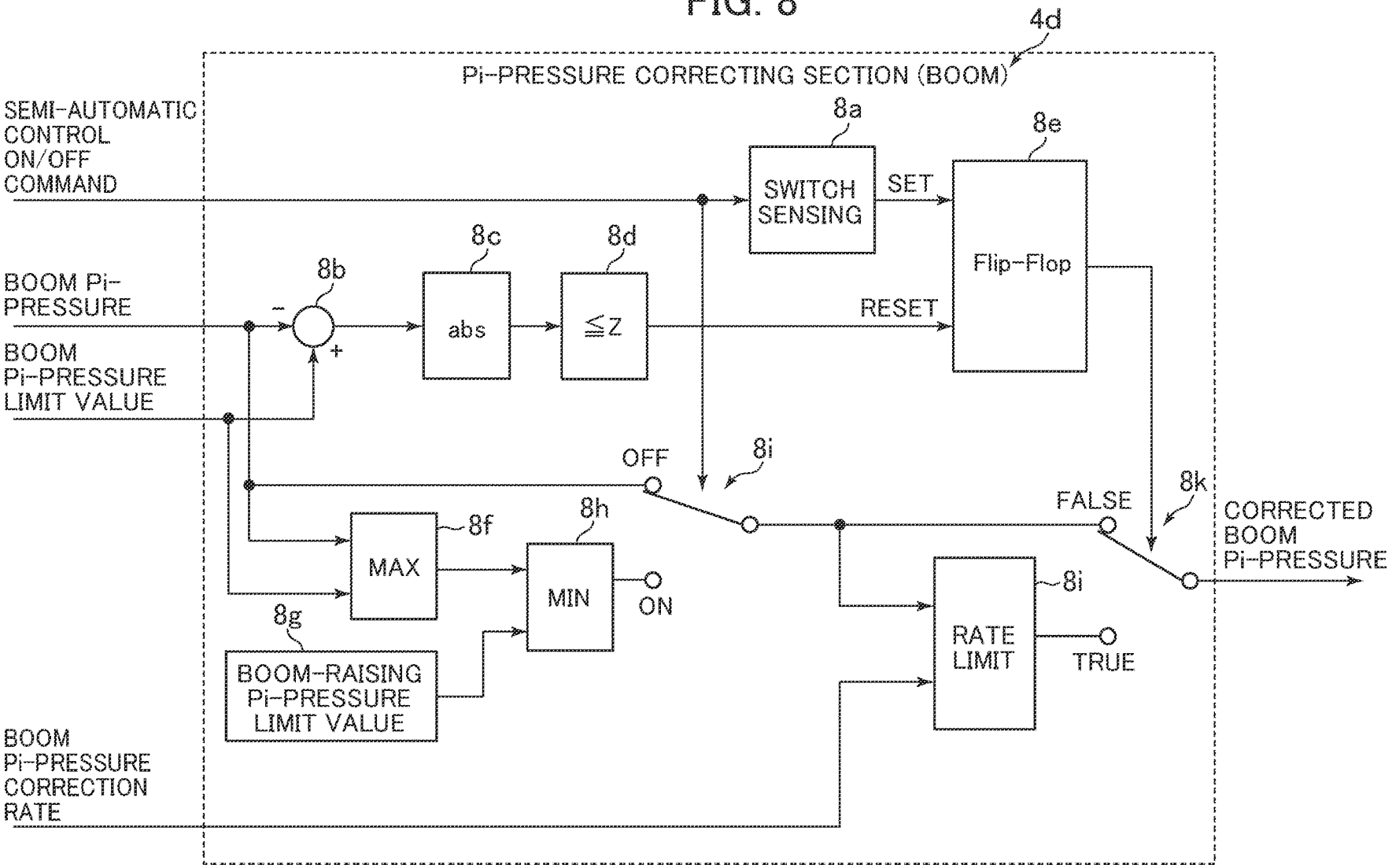
FIG. 8 is a detail view of a boom Pi-pressure correcting section.

First, calculating a corrected Pi-pressure of the boom 405 (boom cylinder 32*a* (first hydraulic actuator)) is explained by using FIG. 8. Here, a boom Pi-pressure generated by the operation lever 26 is referred to as a "first control signal," and a boom Pi-pressure limit value calculated by the boom Pi-pressure limit value calculating section 4*b* is referred to as a "second control signal" in some cases. The boom Pi-pressure correcting section 4*d* in FIG. 8 includes a switch sensing section 8*a*, a subtracting section 8*b*, an absolute-value calculating section 8*c*, a comparing section 8*d*, a Flip-Flop section 8*e*, a maximum-value selecting section 8*f*, a boom-raising Pi-pressure limit value storage section 8*g*, a minimum-value selecting section 8*h*, a first switching section 8*i* (control-signal switching section), a rate limit section 8*j* and a second switching section 8*k*.

The switch sensing section 8*a* receives an input of the switch position of the switch 30, and in a case where a change of the switch position from one switch position to the other switch position is sensed, the switch sensing section 8*a* outputs 1 as the SET value to the Flip-Flop section 8*e*. On the other hand, in a case where the change of the switch position is not sensed, the switch sensing section 8*a* outputs 0 as the SET value to the Flip-Flop section 8*e*.

The subtracting section 8*b* outputs a value obtained by subtracting a boom Pi-pressure (first control signal) generated by the operation lever 26 from a boom Pi-pressure limit value (second control signal) calculated by the boom Pi-pressure limit value calculating section 4*b*. The absolute-value calculating section 8*c* outputs the absolute value of the output (the difference between the boom Pi-pressure and the boom Pi-pressure limit value) of the subtracting section 8*b*. The comparing section 8*d* performs comparison between the output value (the absolute value of the difference between the boom Pi-pressure and the boom Pi-pressure limit value) of the absolute-value calculating section 8*c* and a predetermined value Z, and in a case where the output value of the absolute-value calculating section 8*c* is equal to or smaller than the predetermined value Z, comparing section 8*d* outputs 1 as the RESET value to the Flip-Flop section 8*e*. On the other hand, in a case where the output value of the absolute-value calculating section 8*c* is larger than the predetermined value Z, the comparing section 8*d* outputs zero as the RESET value to the Flip-Flop section 8*e*. For example, the predetermined value Z is preferably set to a value equal to or smaller than 0.5 [MPa].

The Flip-Flop section 8*e* outputs FALSE (0) in a case where both the SET value and the RESET value are 1, outputs TRUE (1) in a case where the SET value is 1 and the RESET value is 0, outputs FALSE (0) in a case where the SET value is 0 and the RESET value is 1, and outputs a value which is the same as the previous output in a case where both the SET value and the RESET value are 0.

The maximum-value selecting section 8*f* outputs the larger one (MAX value) of the boom Pi-pressure and the boom Pi-pressure limit value.

A boom-raising Pi-pressure limit value set to any value smaller than a Pi-pressure obtained when the operation amount of the operation lever 26 is the maximum (at the time of so-called full-lever operation) is stored in the boom-raising Pi-pressure limit value storage section 8*g*. The limit value is set for the purpose of lowering the actuator speed in order to make sure that MC is precise, and is typically set approximately to a Pi-pressure obtained at the time of half-lever operation. It should be noted, however, that in a case where precision is not required, a case where precision can be achieved without lowering the speed by using a more highly functional system and other cases, the minimum-value selecting section 8*h* and setting of the boom-raising Pi-pressure limit value may be omitted.

The minimum-value selecting section 8*h* outputs the smaller one (MIN value) of the output value of the maximum-value selecting section 8*f* and the boom-raising Pi-pressure limit value.

The first switching section 8*i* outputs the output of the minimum-value selecting section 8*h* in a case where the switch 30 is at the ON position, and outputs the boom Pi-pressure in a case where the switch 30 is at the OFF position.

The rate limit section 8*j* applies a rate limit defined by the boom Pi-pressure correction rate output from the Pi-pressure correction-rate calculating section 4*c* to the output of the first switching section (control-signal switching section) 8*i*, and outputs the resultant output. That is, the rate limit section 8*j* limits, to the boom Pi-pressure correction rate indicating a predetermined change rate, a control-signal temporal change rate of the control signal (any one of the boom Pi-pressure, the boom Pi-pressure limit value and the boom-raising Pi-pressure limit value) output from the first switching section 8*i*, and outputs the control signal obtained after the limitation. In a specific situation, when the control signal for controlling the boom cylinder 32*a* has been switched from one control signal of the boom Pi-pressure (first control signal) and the boom Pi-pressure limit value (second control signal) to the other control signal by switching operation of the switch 30 by an operator, the rate limit section 8*j* limits, to the boom Pi-pressure correction rate, the control-signal temporal change rate at which the one control signal (the control signal before the switch) is changed to the other control signal (the control signal after the switch), and outputs the control signal obtained after the limitation.

The second switching section 8*k* outputs the output of the first switch 8*i* in a case where the output from the Flip-Flop section 8*e* is FALSE, and outputs the output of the rate limit section 8*j* in a case where the output from the Flip-Flop section 8*e* is TRUE. The output of the second switching section 8*k* is output from the corrected Pi-pressure calculating section 3*a* to an external device as a corrected Pi-pressure (corrected boom Pi-pressure).

With the logic of the boom Pi-pressure correcting section 4*d* configured as illustrated in FIG. 8, the controller 20 controls the boom cylinder 32*a* on the basis of either the first control signal or the second control signal when the switch 30 is switched to the ON position, controls the boom cylinder 32*a* on the basis of the first control signal when the switch 30 is switched to the OFF position, and limits, to the boom Pi-pressure correction rate, the control-signal temporal change rate at which one of the first control signal and the second control signal is changed to the other control signal when the control signal for controlling the boom cylinder 32*a* has been switched from the one control signal to the other control signal by switching operation on the switch 30, and controls the boom cylinder 32*a* on the basis of the control signal obtained after the limitation. Thereby, the following functions are realized specifically.

(1-1) In a case where the switch 30 has been switched from the OFF position to the ON position, the first switching section 8*i* is switched to the position of ON in FIG. 8, and outputs the output of the minimum-value selecting section 8*h* (i.e. any one of the boom Pi-pressure, the boom Pi-pressure limit value and the boom-raising Pi-pressure limit value). In addition, since the SET value becomes 1, and the RESET value becomes 0 at this time, the Flip-Flop section 8*e* outputs TRUE, thereby the second switching section is switched to the position of TRUE in FIG. 8, and a value obtained by applying a limitation with the boom Pi-pressure correction rate to the output from the minimum-value selecting section 8*h* is output as the corrected boom Pi-pressure. That is, the control signal gradually changes toward the value output from the minimum-value selecting section 8*h* after the switch of the switch 30. Thereby, even if the switch 30 is switched to the ON position during boom-operation, the corrected boom Pi-pressure does not exhibit a steep gradient, and so the speed change of the boom cylinder 32*a* does not exhibit a steep gradient.

(1-2) In a case where the switch 30 has been switched from the ON position to the OFF position, the first switching section 8*i* is switched to the OFF position in FIG. 8, and outputs the boom Pi-pressure. In addition, since the SET value becomes 1, and the RESET value becomes 0 at this time, the Flip-Flop section 8*e* outputs TRUE, thereby the second switching section is switched to the TRUE position in FIG. 8, and a value obtained by applying a limitation with the boom Pi-pressure correction rate to the boom Pi-pressure is output as the corrected boom Pi-pressure. That is, the control signal gradually changes toward the boom Pi-pressure obtained after the switch of the switch 30. Thereby, even if the switch 30 is switched to the OFF position during boom-operation, the corrected boom Pi-pressure does not exhibit a steep gradient, and so the speed change of the boom cylinder 32*a* does not exhibit a steep gradient.

(2) In a case where the difference between the boom Pi-pressure and the boom Pi-pressure limit value becomes equal to or smaller than a certain value (=Z) after the elapse of a length of time after the switch of the switch 30, the corrected boom Pi-pressure becomes a value to which the boom Pi-pressure correction rate is not applied. Thereby, the rate limit is effective only immediately after the switch of the switch 30, and it is possible to prevent responses to boom-operation from remaining slow.

Figure 9:
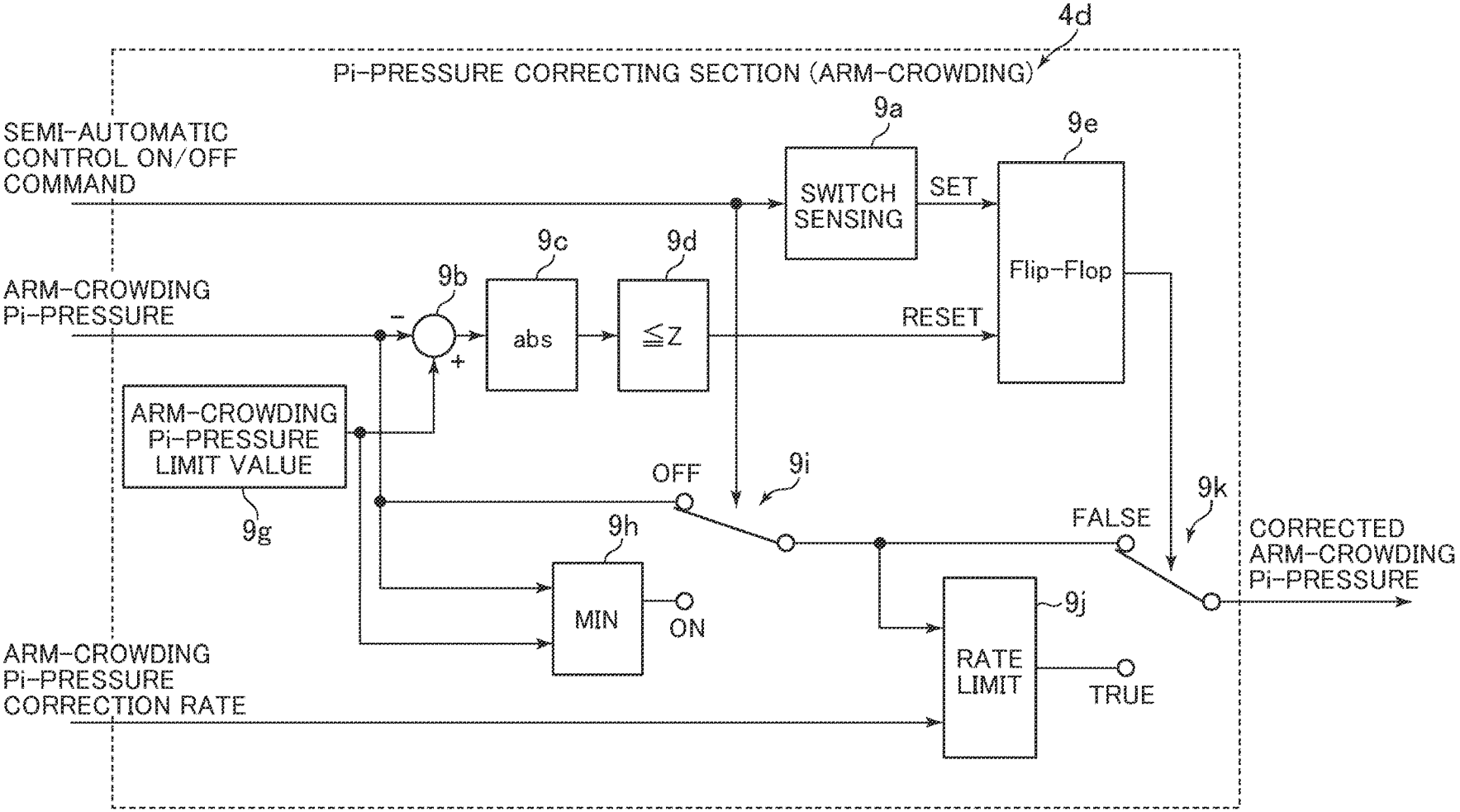
FIG. 9 is a detail view of an arm-crowding Pi-pressure correcting section.

Next, calculation of a corrected Pi-pressure for crowding-operation of the arm 406 (arm cylinder 32*b* (second hydraulic actuator)) is explained by using FIG. 9. What is intended to be realized is nearly the same as what is intended to be realized for the boom, and an arm-crowding Pi-pressure limit value is set in order to improve precision in a similar manner to that for the boom. Here, an arm-crowding Pi-pressure generated by the operation lever 26 is referred to as a "third control signal," and an arm-crowding Pi-pressure limit value stored in the arm-crowding Pi-pressure limit value storage section 9*g* is referred to as a "fourth control signal" in some cases. The arm-crowding Pi-pressure correcting section 4*d* in FIG. 9 includes a switch sensing section 9*a*, a subtracting section 9*b*, an absolute-value calculating section 9*c*, a comparing section 9*d*, a Flip-Flop section 9*e*, an arm-crowding Pi-pressure limit value storage section 9*g*, a minimum-value selecting section 9*h*, a first switching section 9*i* (control-signal switching section), a rate limit section 9*j* and a second switching section 9*k*.

The switch sensing section 9*a* receives an input of the switch position of the switch 30, and in a case where a change of the switch position from one switch position to the other switch position is sensed, the switch sensing section 9*a* outputs 1 as the SET value to the Flip-Flop section 9*e*. On the other hand, in a case where a change of the switch position is not sensed, the switch sensing section 9*a* outputs 0 as the SET value to the Flip-Flop section 9*e*.

The subtracting section 9*b* outputs a value obtained by subtracting an arm-crowding Pi-pressure (third control signal) generated by the operation lever 26 from an arm-crowding Pi-pressure limit value (fourth control signal) stored in the arm-crowding Pi-pressure limit value storage section 9*g*. The absolute-value calculating section 9*c* outputs the absolute value of the output (the difference between the arm-crowding Pi-pressure and the arm-crowding Pi-pressure limit value) of the subtracting section 9*b*. The comparing section 9*d* performs comparison between the output value (the absolute value of the difference between the arm-crowding Pi-pressure and the arm-crowding Pi-pressure limit value) of the absolute-value calculating section 9*c* and a predetermined value Z, and in a case where the output value of the absolute-value calculating section 9*c* is equal to or smaller than the predetermined value Z, the comparing section 9*d* outputs 1 as the RESET value to the Flip-Flop section 9*e*. On the other hand, in a where hat the output value of the absolute-value calculating section 9*c* is larger than the predetermined value Z, the comparing section 9*d* outputs 0 as the RESET value to the Flip-Flop section 9*e*. For example, the predetermined value Z is preferably set to a value equal to or smaller than 0.5 [MPa].

The Flip-Flop section 9*e* outputs FALSE (0) in a case where both the SET value and the RESET value are 1, outputs TRUE (1) in a case where the SET value is 1 and the RESET value is 0, outputs FALSE (0) in a case where the SET value is 0 and the RESET value is 1, and outputs a value which is the same as the previous output in a case where both the SET value and the RESET value are 0.

An arm-crowding Pi-pressure limit value set to any value smaller than a Pi-pressure obtained when the operation amount of the operation lever 26 is the maximum (at the time of so-called full-lever operation) is stored in the arm-crowding Pi-pressure limit value storage section 9*g*. The limit value is set for the purpose of lowering the actuator speed in order to make sure that MC is precise, and is typically set approximately to a Pi-pressure obtained at the time of half-lever operation. It should be noted, however, that in a case where precision is not required, a case where precision can be achieved without lowering the speed by using a more highly functional system and other cases, the minimum-value selecting section 9*h* and setting of the limit value may be omitted. That is, the arm-crowding Pi-pressure correcting section can be omitted.

The minimum-value selecting section 9*h* outputs the smaller one (MIN value) of the arm-crowding Pi-pressure and the arm-crowding Pi-pressure limit value.

The first switching section 9*i* outputs the output of the minimum-value selecting section 9*h* in a case where the switch 30 is at the ON position, and outputs the arm-crowding Pi-pressure in a case where the switch 30 is at the OFF position.

The rate limit section 9*j* applies a rate limit defined by an arm-crowding Pi-pressure correction rate output from the Pi-pressure correction-rate calculating section 4*c* to the output of the first switching section 9*i* (control-signal switching section), and outputs the resultant output. That is, the rate limit section 9*j* limits, to the arm-crowding Pi-pressure correction rate indicating a predetermined change rate, a control-signal temporal change rate of the control signal (any one of the arm-crowding Pi-pressure and the arm-crowding Pi-pressure limit value) output from the first switching section 9*i*, and outputs the control signal obtained after the limitation.

The second switching section 9*k* outputs the output of the first switch 9*i* in a case where the output from the Flip-Flop section 9*e* is FALSE, and outputs the output of the rate limit section 9*j* in a case where the output from the Flip-Flop section 9*e* is TRUE. The output of the second switching section 9*k* is output from the corrected Pi-pressure calculating section 3*a* to an external device as a corrected Pi-pressure (corrected arm-crowding Pi-pressure).

Note that although not explained, correction can be performed with logic similar to that in FIG. 9 also for arm-dumping, bucket-crowding, bucket-dumping, left swing and right swing other than those explained above, by using Pi-pressures that assume positive values.

<2.1.4. Pi-Pressure Correction-Rate Calculating Section 4*c*>

Figure 7:
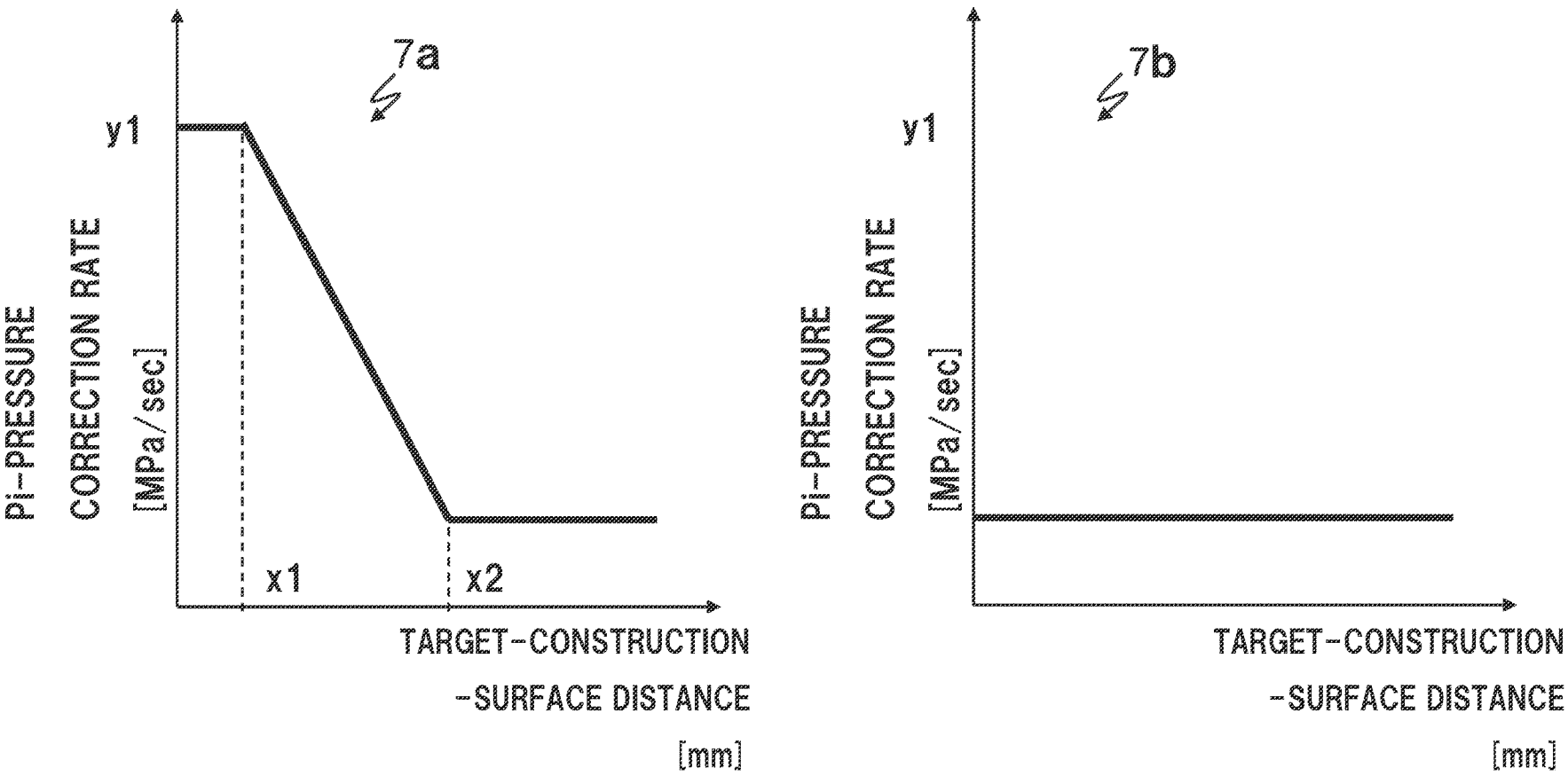
FIG. 7 is a calculation table for a Pi-pressure correction rate.

The Pi-pressure correction-rate calculating section 4*c* works out a Pi-pressure correction rate [MPa/sec] used in a rate limit section of a Pi-pressure correcting section 4*d* (e.g. "8*j*" in FIG. 8 and "9*j*" in FIG. 9), on the basis of the target-construction-surface distance D computed at the target-construction-surface distance calculating section 4*a* and the table in FIG. 7. The Pi-pressure correction rate is applied at the time of a switch of the switch 30 so as to reduce the gradient of an actuator speed to make the gradient less steep.

The Pi-pressure correction rate is worked out on the basis of the direction of a component perpendicular to the target construction surface 60 of a velocity vector of the bucket tip, and on the target-construction-surface distance D. Specifically, in a case where the bucket tip is approaching the target construction surface 60, the Pi-pressure correction-rate calculation table 7*a* for approaching directions (see FIG. 7) is used, and at the time when the bucket tip is moving away from the target construction surface 60, the Pi-pressure correction-rate calculation table 7*b* for receding directions (see FIG. 7) is used. That is, in the present embodiment, the tables used are different between the case where the bucket tip is approaching the target construction surface 60 and the case where the bucket tip is moving away from the target construction surface 60, for the difference between Pi-pressure correction rates used for those cases. A reason why the different tables are used in this manner is that in a case where the bucket tip is being operated in a direction to approach the target construction surface 60, there is a fear that the bucket 407 moves down into the target construction surface 60.

In the table 7*b* for receding directions, the Pi-pressure correction rate is set to a certain value no matter what the target-construction-surface distance D is. On the other hand, in the table 7*a* for approaching directions, the Pi-pressure correction rate is set to the same value as that in the table for receding directions in the range where the target-construction-surface distance D is larger than x2, and the value is the minimum value over the whole range. In addition, in the range where the target-construction-surface distance D is equal to or larger than x1, and equal to or smaller than x2, the Pi-pressure correction rate is set so as to increase monotonically as the target-construction-surface distance D decreases. Furthermore, in the range where the target-construction-surface distance D is smaller than x1, the Pi-pressure correction rate is again set to a certain value y1, and the value is the maximum value over the whole range. Preferably, x2 is set to a value equal to or smaller than d1 in FIG. 6.

Since if the gradient of the Pi-pressure correction rate is made excessively small in a case of approaching directions, the bucket 407 undesirably moving down into the target construction surface 60, the bucket 407 is prevented from undesirably moving down into the target construction surface 60 by setting the Pi-pressure correction rate so as to increase monotonically as the target-construction-surface distance D decreases from x2 to x1 on the basis of the Pi-pressure correction-rate calculation table 7*a* for approaching directions. On the contrary, since there is no need for such a concern in a case of receding directions, the Pi-pressure correction-rate calculation table 7*b* for receding directions in which the rate is fixed at a small value is used for preventing rapid changes of an actuator speed.

Meanwhile, the value of y1 in the Pi-pressure correction-rate calculation table 7*a* for approaching directions is set to a value which is sufficient for inhibiting the bucket tip from moving into the target construction surface 60. Accordingly, the value of x1 may be determined on the basis of the precision of semi-automatic control required for products (e.g. x1=100 [mm] if the required precision is ±100 [mm] relative to a target surface). Note that these two Pi-pressure correction-rate calculation tables 7*a* and 7*b* may have different definitions from each other for different actuators as long as they behave in manners that are similar to those explained above.

<2.2. Actuator Target Output-Power Calculating Section 3*b*>

Figure 10:
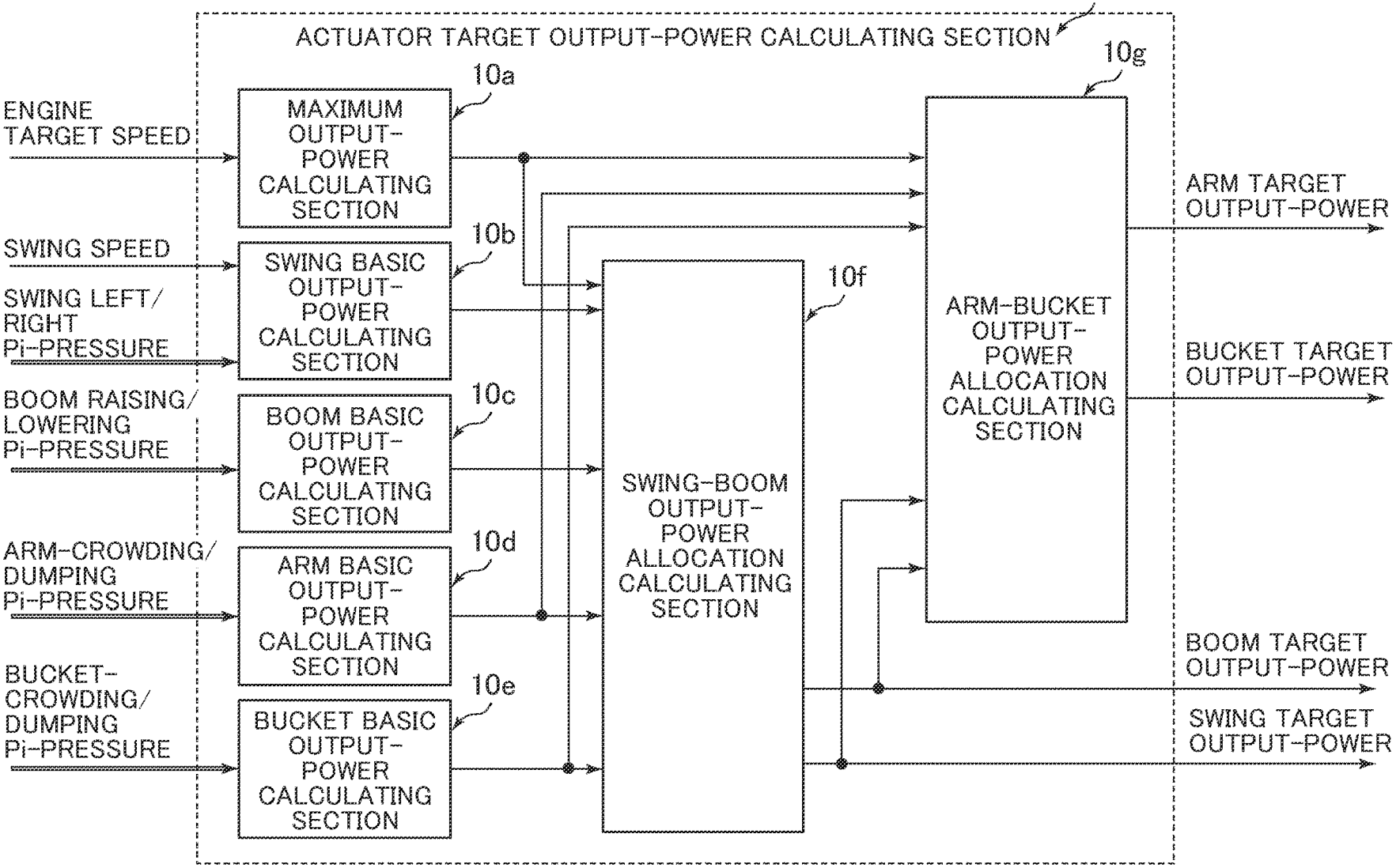
FIG. 10 is a detail view of an actuator target output-power calculating section 3*b*.

FIG. 10 is a detail view of the actuator target output-power calculating section 3*b*. The actuator target output-power calculating section 3*b* has a maximum output-power calculating section 10*a*, a swing basic output-power calculating section 10*b*, a boom basic output-power calculating section 10*c*, an arm basic output-power calculating section 10*d*, a bucket basic output-power calculating section 10*e*, a swing-boom output-power allocation calculating section 10*f* and an arm-bucket allocation output-power calculating section 10*g*, and computes target output-powers for the hydraulic cylinders 32*a*, 32*b* and 32*c* and the swing hydraulic motor 28.

Figure 11:
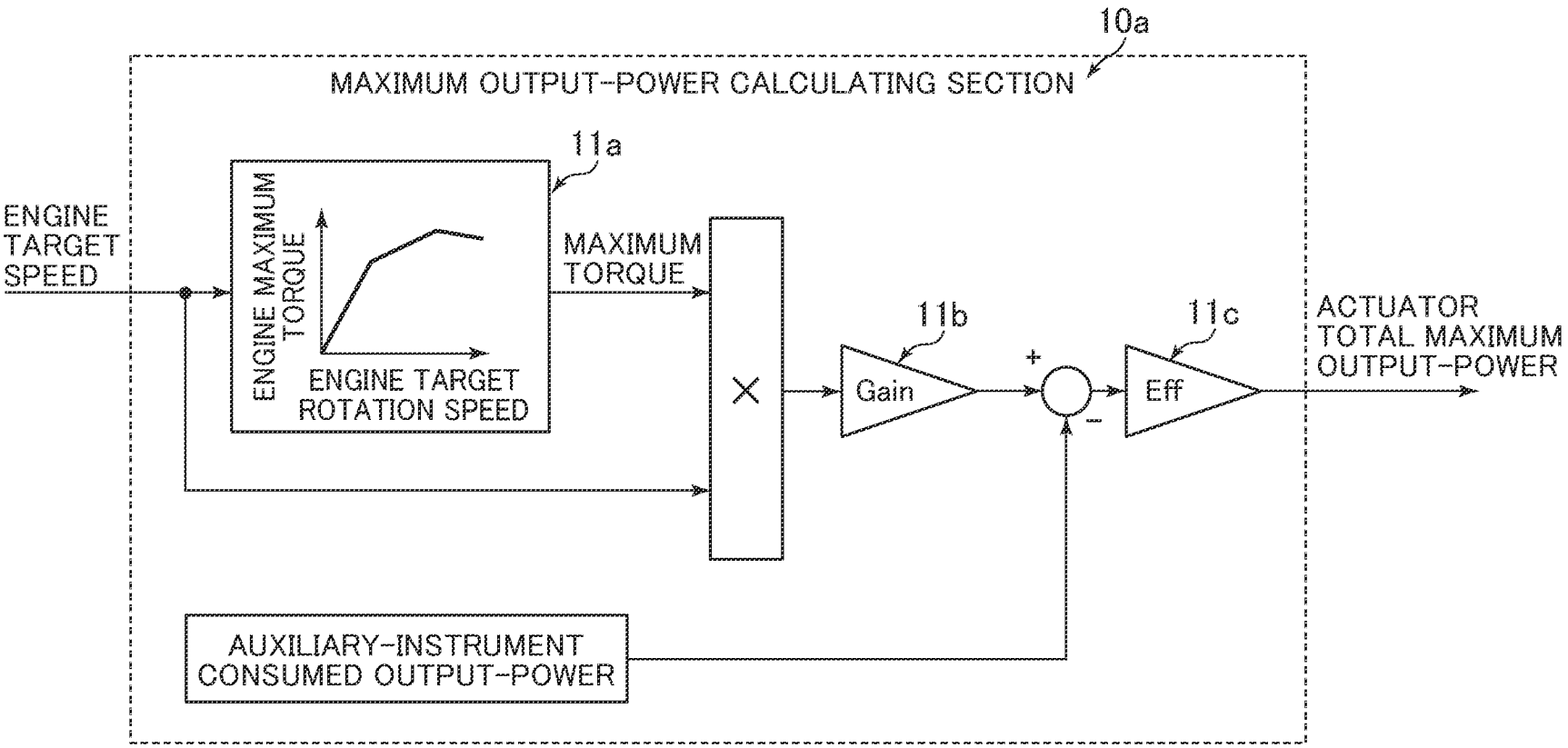
FIG. 11 is a detail view of a maximum output-power calculating section 10*a*.

FIG. 11 is a detail view of the maximum output-power calculating section 10*a*. The maximum output-power calculating section 10*a* receives an input of an engine target speed from the ECU 22. The maximum output-power calculating section 10*a* computes the actuator maximum output-power by causing, at the Gain section 11*b*, a coefficient for conversion into the output dimension to act on the product of the engine target speed and a maximum torque obtained by inputting the engine target speed to an engine speed maximum torque table 11*a*, subtracting from the resultant value a consumed output-power of auxiliary instruments (an air conditioner, radio, and the like mounted on the hydraulic excavator); and then multiplying the obtained value and an efficiency at the Eff section 11*c*. The "efficiency" used at the Eff section 11*c* can be determined from a typical value of efficiency at which an output-power input to the hydraulic pump 23 is converted into works of an actuator, and in more detail, the efficiency can also be determined by using an efficiency table for which an engine output-power is used as an input. With the calculation explained above, the actuator total maximum output-power is computed.

Figure 12:
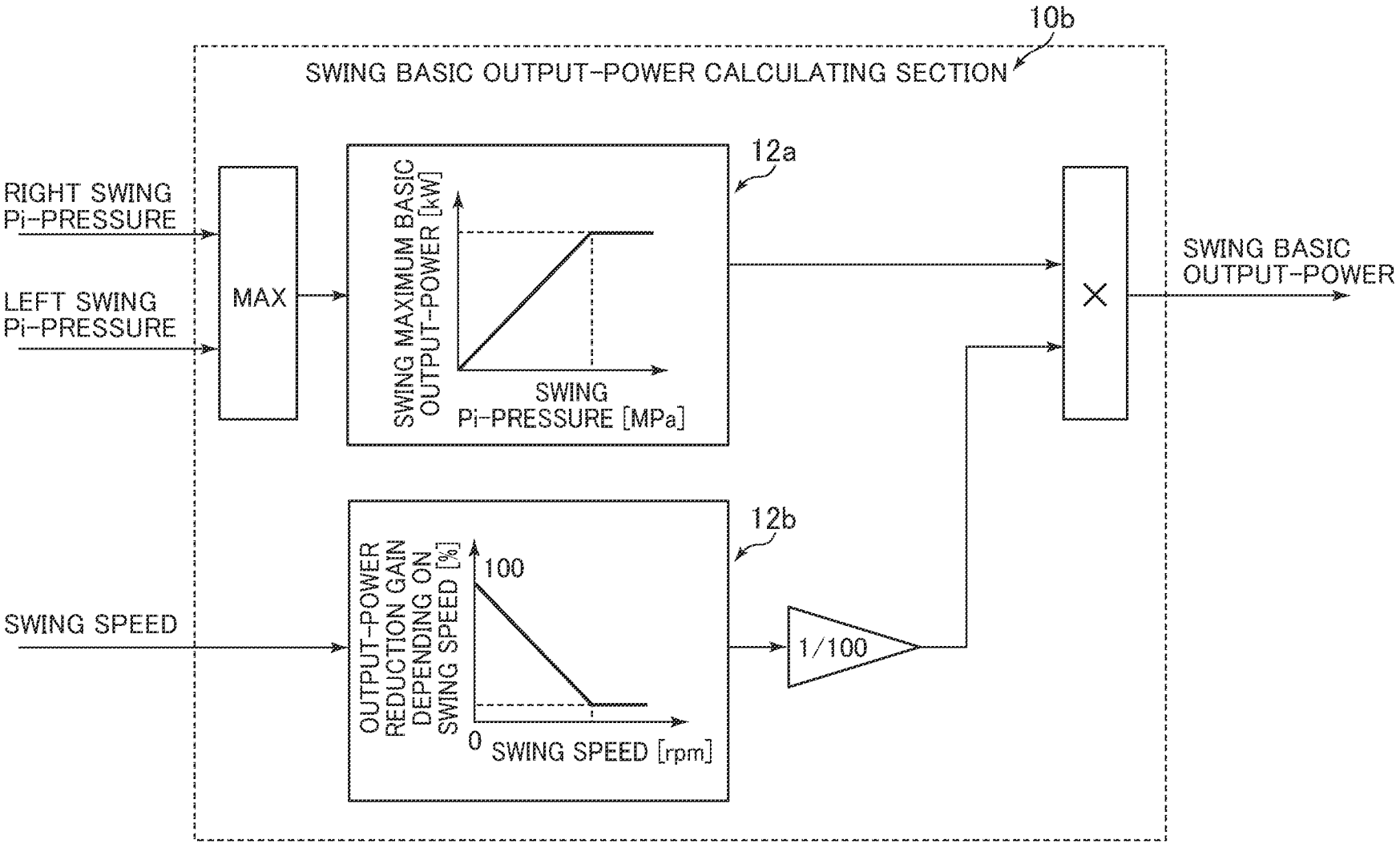
FIG. 12 is a detail view of a swing basic output-power calculating section 10*b*.

FIG. 12 is a detail view of the swing basic output-power calculating section 10*b*. The swing basic output-power calculating section 10*b* receives an input of a right swing Pi-pressure (right-swing operation amount) and a left swing Pi-pressure (left-swing operation amount) of the swing structure 402 acquired from the pressure sensor 41, and a swing speed of the swing structure 402 acquired from the speed sensor 43, and computes a swing basic output-power which is a target output-power obtained at the time when swing operation is performed singly. First, the maximum value of a left/right swing Pi-pressure is input to a swing maximum basic output-power table 12*a* to determine a swing maximum basic output-power. The table is set such that the swing maximum basic output-power increases monotonically as the swing Pi-pressure increases. Next, the swing speed is input to the swing output-power reduction gain table 12*b* to determine an output-power reduction gain, and the product of the output-power reduction gain and the swing maximum basic output-power is obtained to thereby determine the swing basic output-power. The swing output-power reduction gain table 12*b* is set such that the output-power reduction gain decrease monotonically as the swing speed increases, because the highest output-power is necessary for a swing at the beginning of the motion and the required output-power decreases gradually after the beginning of the motion. Accordingly, tuning is preferably performed in advance such that a smooth sense of swing operation can be attained.

Figure 13:
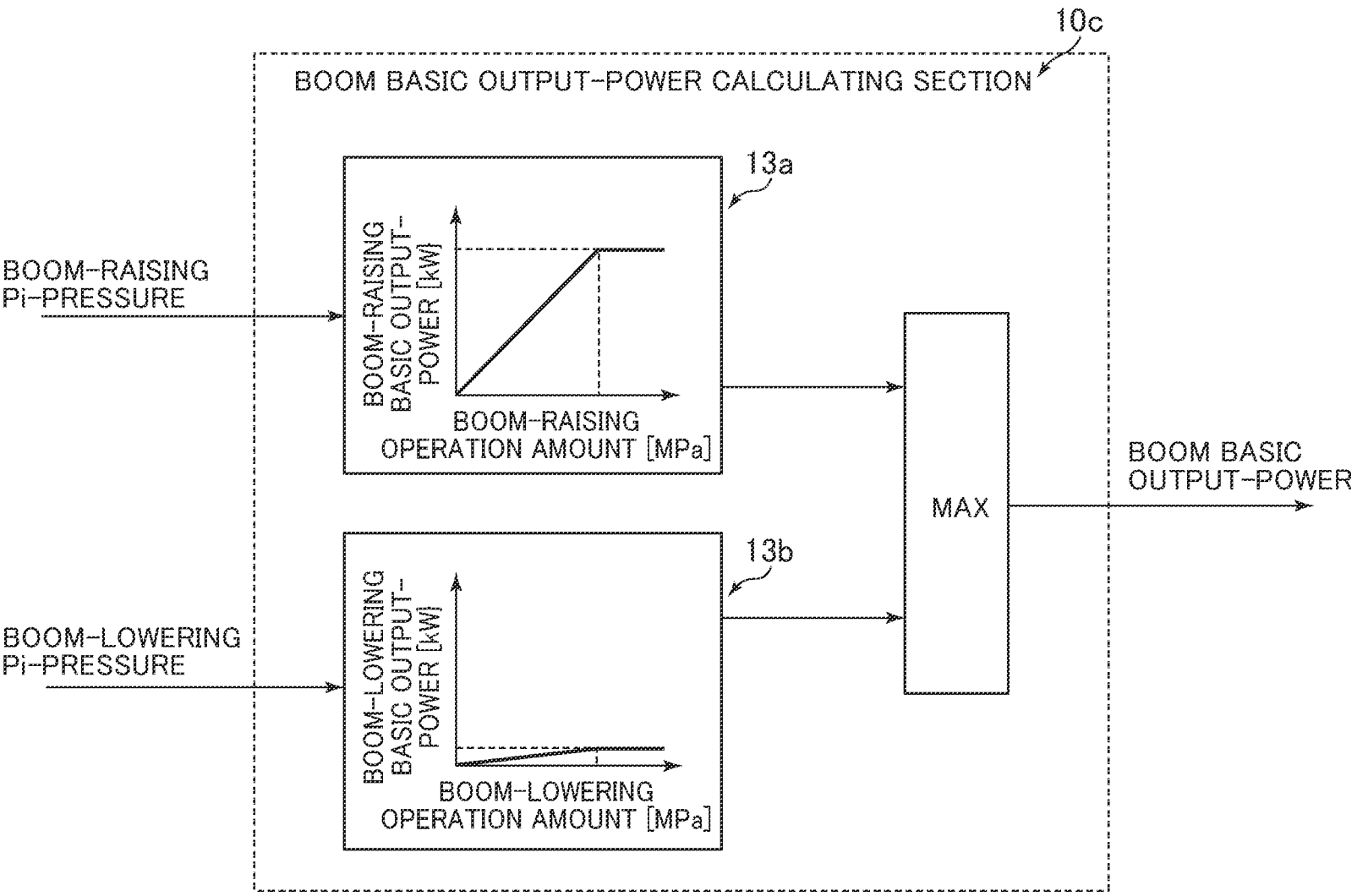
FIG. 13 is a detail view of a boom basic output-power calculating section 10*c*.

FIG. 13 is a detail view of the boom basic output-power calculating section 10*c*. The boom basic output-power calculating section 10*c* receives inputs of a boom-raising Pi-pressure (boom-raising operation amount) and a boom-lowering Pi-pressure (boom-lowering operation amount), and computes a boom basic output-power. The boom-raising Pi-pressure and the boom-lowering Pi-pressure are input to a dedicated boom-raising basic output-power table 13*a* and a dedicated boom-lowering basic output-power table 13*b* to be converted into a boom-raising basic output-power and a boom-lowering basic output-power, respectively, and the larger value of the basic output-powers is used as the boom basic output-power. Similar to the case of swings, the basic output-power is set so as to increase monotonically as the Pi-pressure (operation amount) increases, and each basic output-power indicates an output-power required at the time when operation is performed singly.

The arm basic output-power calculating section 10*d* and the bucket basic output-power calculating section 10*e* determine the respective basic output-powers in a similar manner to the manner how the boom basic output-power calculating section 10*c* works out the boom basic output-power. The calculation by both the calculating sections 10*d* and 10*e* are equivalent to the calculation as realized by reading the word "boom" in FIG. 13 as meaning "arm" or "bucket," and accordingly explanations thereof are omitted.

Figure 14:
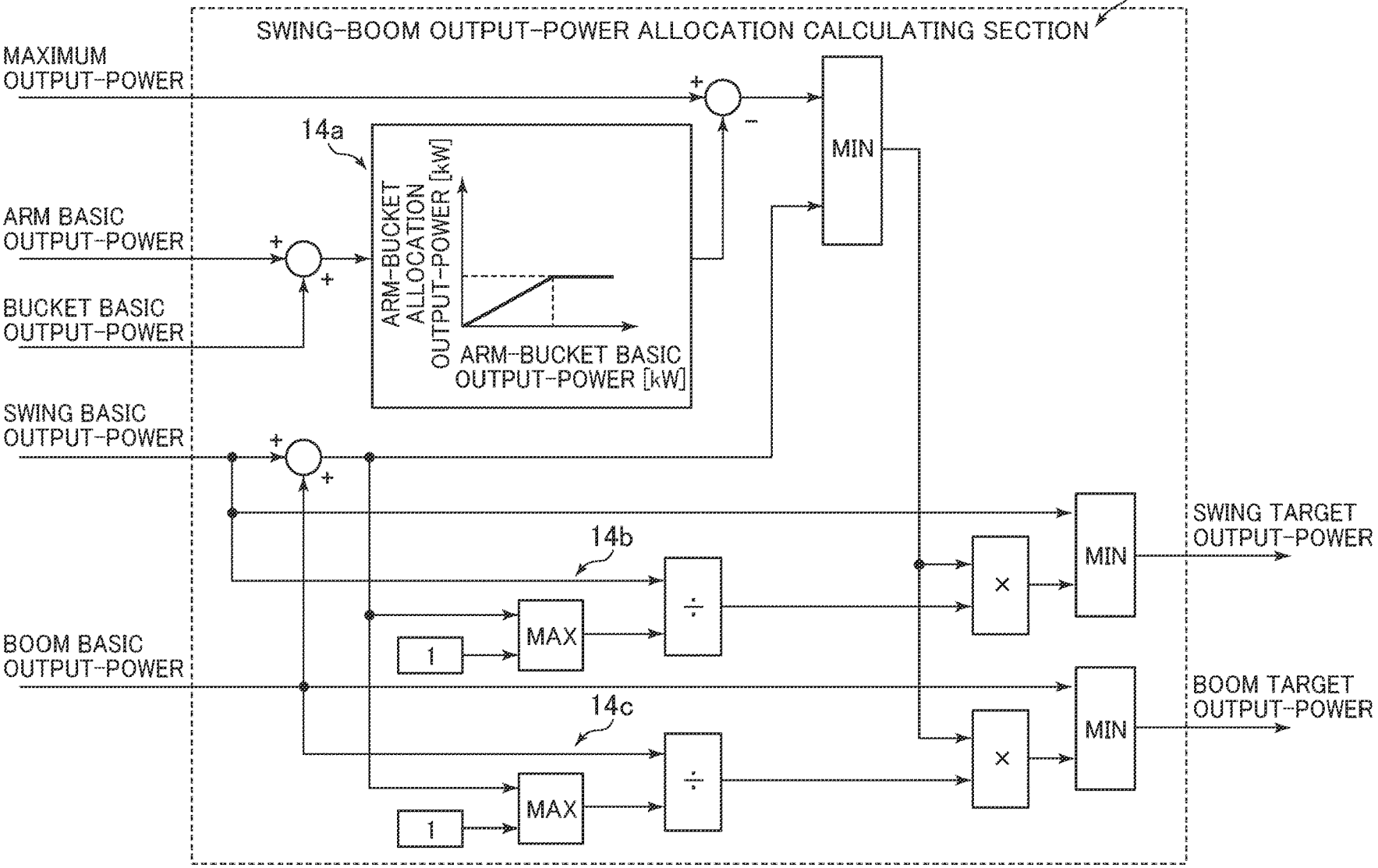
FIG. 14 is a detail view of a swing-boom output-power allocation calculating section 10*f*.

FIG. 14 is a detail view of the swing-boom output-power allocation calculating section 10*f*. The swing-boom output-power allocation calculating section 10*f* receives inputs of the maximum output-power computed at the maximum output-power calculating section 10*a*, and the swing basic output-power, the boom basic output-power, the arm basic output-power and the bucket basic output-power computed at the four basic output-power calculating sections 10*b*, 10*c*, 10*d* and 10*e*, to compute the swing target output-power and the boom target output-power.

First, the swing-boom output-power allocation calculating section 10*f* inputs the total value of the arm basic output-power and the bucket basic output-power to an arm-bucket allocation output-power table 14*a* to compute an arm-bucket allocation output-power. The arm-bucket allocation output-power table 14*a* is also set such that the output-power increases monotonically as the input basic output-power increases, but the output-power is set to a value always smaller than the input. This is based on an intention that since output-powers for the boom and the swing are given higher priority over output-powers for the arm and the bucket in the system of the present embodiment, certain output-powers are reserved for the arm and the bucket in advance for a case where they are operated simultaneously.

Next, the swing-boom output-power allocation calculating section 10*f* computes, at a swing ratio calculating section 14*b*, the ratio of the swing basic output-power to the total of the swing basic output-power and the boom basic output-power, and computes, at a boom ratio calculating section 14*c*, the ratio of the boom basic output-power to the total of the swing basic output-power and the boom basic output-power. Then, the arm-bucket allocation output-power, which is the output of the table 14*a*, is subtracted from the maximum output-power input from the maximum output-power calculating section 10*a*. The smaller one of the value obtained as a result of the subtraction and the swing basic output-power is allocated to the swing and the boom on the basis of the ratios computed at the ratio calculating sections 14*b* and 14*c*, to determine the swing target output-power and the boom target output-power.

Figure 15:
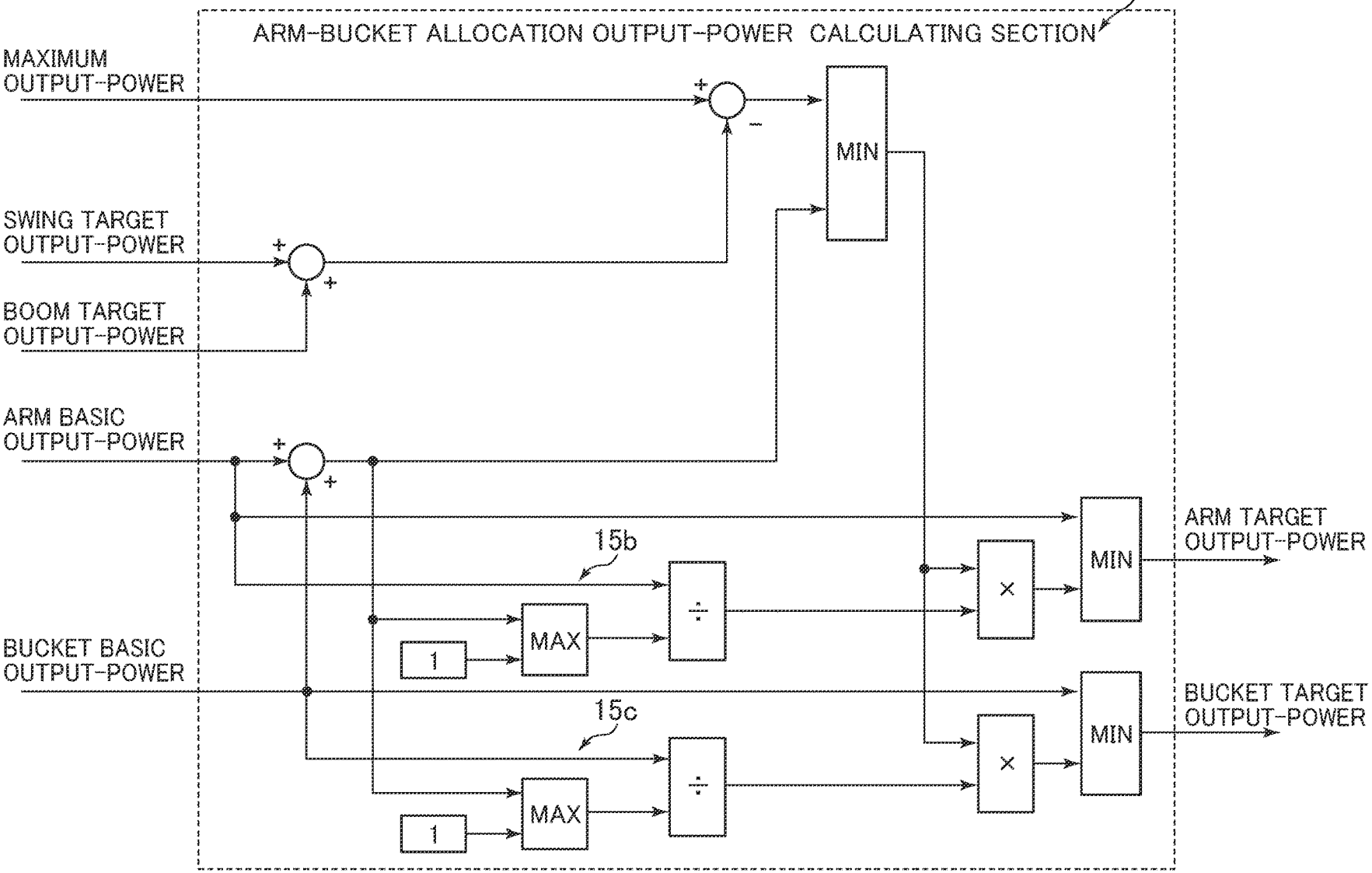
FIG. 15 is a detail view of an arm-bucket allocation output-power calculating section 10*g*.

FIG. 15 is a detail view of the arm-bucket allocation output-power calculating section 10*g*. The arm-bucket allocation output-power calculating section 10*g* receives inputs of the maximum output-power computed at the maximum output-power calculating section 10*a*, the swing target output-power and the boom target output-power computed at the swing-boom output-power allocation calculating section 10*f*, the arm basic output-power computed at the arm basic output-power calculating section 10*d*, and the bucket basic output-power computed at the bucket basic output-power calculating section 10*e*, to computes the arm target output-power and the bucket target output-power.

The arm-bucket allocation output-power calculating section 10*g* computes, at an arm ratio calculating section 15*b*, the ratio of the arm basic output-power to the total of the arm basic output-power and the bucket basic output-power, and computes, at a bucket ratio calculating section 15*c*, the ratio of the bucket basic output-power to the total of the arm basic output-power and the bucket basic output-power. Then, the total value of the swing target output-power and the boom target output-power is subtracted from the maximum output-power. The smaller one of the value obtained as a result of the subtraction and the arm basic output-power is allocated to the arm and the bucket on the basis of the ratios computed at the ratio calculating sections 15*b* and 15*c*, to determine the arm target output-power and the bucket target output-power.

<2.3. Engine Output-Power Command Calculating Section 3*c*>

The engine output-power command calculating section 3*c* divides the total value of the target output-powers of the actuators computed at the actuator target output-power calculating section 3*b* by a typical pump efficiency (e.g. 0.85), and further a typical auxiliary-instrument load (several kilowatts) is added to the quotient to thereby compute an engine output-power required for target operation which is then output as an engine output-power command.

<2.4. Proportional Solenoid Valve Command Voltage Calculating Section 3*d*>

The proportional solenoid valve command voltage calculating section 3*d* (see FIG. 3) determines command values for the proportional solenoid valves from the corrected Pi-pressures computed at the corrected Pi-pressure calculating section 3*a*, increases Pi-pressures of the hydraulic actuators 32*a*, 32*b*, 32*c* and 33, and corrects operation of the front work implement 400. The proportional solenoid valve command voltage calculating section 3*d* retains a characteristics map indicating the magnitude of a voltage that should be applied to a proportional solenoid valve 27 corresponding to a hydraulic actuator for opening the proportional solenoid valve 27 to attain a target Pi-pressure, and computes a command value for the proportional solenoid valve 27 on the basis of the characteristics map.

<3. Operation>

Next, operation to be performed in a case where the switch 30 is operated to switch MC between ON and OFF during boom-operation of the hydraulic excavator configured in the manner explained above is explained.

3.1. MC Switch to be Performed in a Case where the Bucket Tip is Driven by a Boom Pi-Pressure to be Moved Away from the Target Construction Surface 60 (Typically, a Case of Boom-Raising, and the Boom Pi-Pressure is a Positive Pressure)

(3.1.1) A Case where MC has been Switched from OFF to ON

In this case, since boom operation needs not be corrected by MC, the boom Pi-pressure limit value is computed as 0 [Mpa] by the boom Pi-pressure limit value calculating section 4*b*. In a case where MC is switched from OFF to ON in this state by the switch 30, since the first switching section 8*i* is switched to the ON side and the second switching section 8*k* is switched to the TRUE side at that moment, the corrected boom Pi-pressure, which is an output-power, becomes a value obtained by applying the rate limit (boom Pi-pressure correction rate) to the MIN value of the boom Pi-pressure (first control signal) and the boom-raising Pi-pressure limit value. Thereafter, when the lever operation is interrupted and the boom Pi-pressure approaches 0 [MPa], since the boom Pi-pressure≈the boom Pi-pressure limit value, and so 1 is input to the Flip-Flop section 8*e* as the RESET value. Thereby, the second switching section 8*k* is switched to the FALSE side and the rate limit becomes ineffective, and thereafter normal MC is performed.

(3.1.2) A Case where MC has been Switched from ON to OFF

Similar to (1) explained above, the boom Pi-pressure limit value is computed as 0 [MPa]. In a case where MC is switched from OFF to ON by the switch 30, since the first switching section 8*i* is switched to the OFF side and the second switching section 8*k* is switched to the TRUE side at that moment, the corrected boom Pi-pressure, which is an output-power, becomes a value obtained by applying the rate limit (boom Pi-pressure correction rate) to the boom Pi-pressure (first control signal). Thereafter, when the lever operation is interrupted, and the boom Pi-pressure becomes 0 [MPa], the second switching section 8*k* is switched to the FALSE side, the rate limit becomes ineffective, and thereafter front-implement operation is performed by normal control (non-MC).

3.2. MC Switch to be Performed in a Case where the Bucket Tip is Driven by a Boom Pi-Pressure to Approach the Target Construction Surface 60 (Typically, a Case of Boom-Lowering, and the Boom Pi-Pressure is a Negative Pressure)

(3.2.1) A Case where MC has been Switched from OFF to ON

MC in this case tries to actuate boom-raising in order to lower the bucket-tip lowering speed, and the boom Pi-pressure limit value becomes a positive value. Accordingly, at the time when MC is turned ON, the boom Pi-pressure limit value>the boom Pi-pressure is satisfied. At that moment when MC is switched to ON by the switch 30, since the first switching section 8*i* is switched to the ON side and the second switching section 8*k* is switched to the TRUE side, and so the corrected boom Pi-pressure, which is an output-power, becomes a value obtained by applying the rate limit (boom Pi-pressure correction rate) to the MIN value of the boom Pi-pressure limit value and the boom-raising Pi-pressure limit value. When the value of the boom Pi-pressure becomes nearly equal to the boom Pi-pressure limit value, 1 is input to the Flip-Flop section 8*e* as the RESET value. Thereby, the second switching section 8*k* is switched to the FALSE side and the rate limit becomes ineffective, and thereafter normal MC is performed.

(3.2.2) A Case where MC has been Switched from ON to OFF

In this case also, at the time when MC is turned ON, the boom Pi-pressure limit value>the boom Pi-pressure is satisfied. At that moment when MC is switched to OFF by the switch 30, since the first switching section 8*i* is switched to the OFF side and the second switching section 8*k* is switched to the TRUE side, the corrected boom Pi-pressure, which is an output-power, becomes a value obtained by applying the rate limit (boom Pi-pressure correction rate) to the boom Pi-pressure. When the lever operation is interrupted, and the boom Pi-pressure becomes 0 [MPa], the second switching section 8*k* is switched to the FALSE side and the rate limiter becomes ineffective, and thereafter front-implement operation can be performed by normal control (non-MC).

<4. Effects>

According to the present embodiment explained above, actions and effects like the ones mentioned below can be attained.

(1) In the embodiment explained above, the rate limit sections 8*j* and 9*j* are provided, and thereby when MC is switched between ON and OFF by the switch 30, control for limiting the temporal change amount of the corrected Pi-pressure before and after the switch is added to the control performed by the controller 20. Thereby, even in a case where MC is switched between ON and OFF while the work implement 400 is being operated, the actuator speed does not exhibit a steep gradient, and it becomes possible to solve operation stresses caused to operators in conventional techniques since MC cannot be switched between ON and OFF while the operators are operating the work implement 400.

(2) In the embodiment explained above, the Pi-pressure correction-rate calculating section 4*c* uses the table 7*a* (see FIG. 7) to compute the Pi-pressure correction rate in a case where the bucket tip approaches the target construction surface 60, and thereby control for reducing the degree of limitation on the temporal change amount of the Pi-pressure when MC is switched between ON and OFF as the bucket tip approaches the target construction surface 60 is added to the control performed by the controller 20. Thereby, since in a case where the bucket tip is approaching the target construction surface 60, the degree of limitation on the temporal change amount of the Pi-pressure is reduced, it becomes possible to prevent the bucket tip from moving into the target construction surface 60 due to a delay of MC-response of an actuator.

(3) In the embodiment explained above, when the operation lever 26 is at its neutral position, the boom Pi-pressure, and the boom Pi-pressure limit value are both zero, and 1 is input to the Flip-Flop section 8*e* as the RESET value, and thereby control for not limiting the temporal change amount of the Pi-pressure when the operation lever 26 is at its neutral position in an ON/OFF switch of MC is added to the control performed by the controller 20. Thereby, since, when the operation lever 26 is at its neutral position, limitation on the temporal change amount of the Pi-pressure (i.e. limitation on the Pi-pressure by the boom Pi-pressure correction rate) is not performed and the operation usually performed is performed, operation stresses are not caused to operators.

(4) In the embodiment explained above, it is configured such that the minimum-value selecting sections 8*h* and 9*h* are provided and Pi-pressures equal to or lower than limit values set in the limit value storage sections 8*g* and 9*g* are necessarily output to the first switching sections 8*i* and 9*i*, and thereby when MC is turned on, control for limiting the speeds of the hydraulic cylinders 32*a* and 32*b* such that the speeds become lower than the maximum speed at the time when MC is turned off is added to the control performed by the controller 20. Thereby, more precise excavation of the target construction surface 60 can be realized by MC.

<5. Others>

Note that the present invention is not limited to the embodiments explained above, but includes various variants that fall within a scope not deviating from the gist of the present invention. For example, the present invention is not limited to the one that includes all the configurations that are explained in the embodiments explained above, but include ones from which some of the configurations are eliminated. In addition, some of configurations according to an embodiment may be added to or replace configurations according to another embodiment.

Although control signals for the actuators are hydraulic control signals (Pi-pressures) in the example explained above, the control signals are not limited to hydraulic signals, but may be electrical signals.

In addition, although in a portion of the explanation given above where the computation of the limit value V1'*y* at the boom Pi-pressure limit value calculating section 4*b* is explained, the distance from the bucket claw-tip to the target construction surface 60 is defined as the distance D, a reference point (control point) on the front work implement 400-side is not limited to the bucket claw-tip, but can be set to any point on the front work implement 400.

In addition, although the boom cylinder 32*a* among the plurality of hydraulic actuators 28, 33, 32*a*, 32*b* and 32*c* mounted on the hydraulic excavator is automatically actuated in the explanation given above, there are no problems even if the other hydraulic actuators are automatically actuated.

DESCRIPTION OF REFERENCE CHARACTERS

3*a*: Corrected Pi-pressure calculating section
3*b*: Actuator target output-power calculating section
3*c*: Engine output-power command calculating section
3*d*: Proportional solenoid valve command voltage calculating section
4*a*: Target-construction-surface distance calculating section
4*b*: Boom Pi-pressure limit value calculating section (second control signal calculating section)
4*c*: Pi-pressure correction-rate calculating section
4*d*: Pi-pressure correcting section
8*a*: Switch sensing section
8*b*: Subtracting section
8*c*: Absolute-value calculating section
8*d*: Comparing section
8*e*: Flip-Flop section
8*f*: Maximum-value selecting section
8*g*: Boom-raising Pi-pressure limit value storage section
8*h*: Minimum-value selecting section
8*i*: First switching section (control-signal switching section)
8*j*: Rate limit section
8*k*: Second switching section
9*a*: Switch sensing section
9*b*: Subtracting section
9*c*: Absolute-value calculating section
9*d*: Comparing section
9*e*: Flip-Flop section
9*g*: Arm-crowding Pi-pressure limit value storage section
9*h*: Minimum-value selecting section
9*i*: First switching section (control-signal switching section)
9*j*: Rate limit section
9*k*: Second switching section
20: Controller
21: Engine
22: Engine control unit (ECU)
23: Hydraulic pump
24: Gear pump
25: Control valve
26: Operation lever
27: Proportional solenoid valve
28: Swing hydraulic motor
30: Machine-control ON/OFF switch (switching device)
33: Traveling hydraulic motor
32*a*: Boom cylinder (first hydraulic actuator)
32*b*: Arm cylinder (second hydraulic actuator)
32*c*: Bucket cylinder
36: Boom angle sensor
37: Arm angle sensor
38: Bucket angle sensor
39: Machine-body inclination-angle sensor
40: GNNS antenna
41: Pressure sensor for pilot pressure
42: Pressure sensor of each actuator
43: Speed sensor of each actuator
50: Target-construction-surface setting device
51: Engine control dial
400: Front work implement (work implement)
401: Track structure
402: Swing structure
403: Operation room
405: Boom
406: Arm
407: Bucket

The invention claimed is:

1. A work machine comprising:

a work implement;

a first hydraulic actuator that drives the work implement;

an operation device for controlling the first hydraulic actuator in accordance with an operation by an operator;

a machine-control ON/OFF switch that can select a switch position of either an ON position which enables machine control for the first hydraulic actuator or an OFF position which disables the machine control for the first hydraulic actuator; and a controller that outputs a first control signal generated in accordance with the operation to the operation device by the operator when the switch is in the OFF position, and outputs a second control signal that controls the first actuator such that the work implement is kept on or above a target construction surface when the switch is in the ON position and when a distance between the work implement and the target construction surface is equal to or less than a predetermined value, wherein the controller when a control signal for controlling the first hydraulic actuator is switched from one of the first control signal and the second control signal to an other of the first control signal and the second control signal by a switching operation on the switch, enacts a limitation limiting a time rate of change of the control signal to a predetermined change rate, and controls the first hydraulic actuator on a basis of the control signal after the limitation, and controls an operation speed of the first hydraulic actuator so as to be a value lower than a maximum speed of the first hydraulic actuator during the switch being in the ON position.

2. The work machine according to claim 1, wherein the controller has data on the target construction surface with a target shape of a work target of the work implement, the second control signal is a control signal for operating the first hydraulic actuator such that the work implement is positioned above the target construction surface while the operation device is being operated, and in a case where a tip of the work implement approaches the target construction surface, the predetermined change rate is set such that the predetermined change rate increases as a distance between the tip of the work implement and the target construction surface decreases.

3. The work machine according to claim 1, wherein in a case where the operation device is not being operated, the controller does not perform the limitation with the predetermined change rate to the first and the second control signal for controlling the first hydraulic actuator when the switch is switched from the OFF position to the ON position or from the ON position to the OFF position.

4. The work machine according to claim 1, wherein the switch is provided at a grip section of the operation device.

5. The work machine according to claim 1, further comprising a second hydraulic actuator that drives the work implement, wherein the operation device can output a third control signal for the second hydraulic actuator in accordance with the operation by the operator, the controller calculates a fourth control signal to operate the second hydraulic actuator in accordance with a predetermined condition while the operation device is being operated, and controls the second hydraulic actuator on a basis of either the third control signal or the fourth control signal when the third control signal is output from the operation device, and the controller further controls the second hydraulic actuator on a basis of either the third control signal or the fourth control signal when the switch is switched to the ON position, and controls the second hydraulic actuator on a basis of the third control signal when the switch is switched to the OFF position.

* * * * *